US008328524B2

(12) United States Patent
Iimura et al.

(10) Patent No.: US 8,328,524 B2
(45) **Date of Patent: *Dec. 11, 2012**

(54) AIR COMPRESSOR AND METHOD FOR CONTROLLING THE SAME

(75) Inventors: Yoshio Iimura, Ibaraki (JP); Hiroaki Orikasa, Ibaraki (JP); Mitsuhiro Sunaoshi, Ibaraki (JP); Toshiaki Uchida, Ibaraki (JP); Kazuhiro Segawa, Ibaraki (JP)

(73) Assignee: Hitachi Koki Co., Ltd., Tokyo (JP)

( * ) Notice: Subject to any disclaimer, the term of this patent is extended or adjusted under 35 U.S.C. 154(b) by 492 days.

This patent is subject to a terminal disclaimer.

(21) Appl. No.: 12/461,057

(22) Filed: Jul. 30, 2009

(65) Prior Publication Data

US 2009/0288849 A1 Nov. 26, 2009

Related U.S. Application Data

(63) Continuation of application No. 10/780,876, filed on Feb. 19, 2004, now Pat. No. 7,704,052.

(30) Foreign Application Priority Data

Mar. 31, 2003 (JP) ..... P.2003-093933
Apr. 15, 2003 (JP) ..... P.2003-109767
Apr. 15, 2003 (JP) ..... P.2003-109888

(51) Int. Cl.
*F04B 49/00* (2006.01)

(52) U.S. Cl. ..... 417/18

(58) Field of Classification Search ..... 417/12, 417/31, 32, 44.1, 44.11, 18, 20, 36, 43, 44.2, 417/53; 173/11; 700/25, 30, 31
See application file for complete search history.

(56) References Cited

U.S. PATENT DOCUMENTS

| | | | | |
|---|---|---|---|---|
| 4,863,355 | A * | 9/1989 | Odagiri et al. | 417/12 |
| 5,438,829 | A * | 8/1995 | Kubota et al. | 60/410 |
| 5,580,221 | A * | 12/1996 | Triezenberg | 417/44.2 |
| 6,419,454 | B1 * | 7/2002 | Christiansen | 417/4 |
| 6,495,932 | B1 * | 12/2002 | Yoshimizu et al. | 307/150 |
| 7,704,052 | B2 * | 4/2010 | Iimura et al. | 417/44.2 |
| 2002/0182082 | A1 * | 12/2002 | Centers et al. | 417/12 |
| 2003/0132161 | A1 | 7/2003 | Pfeil et al. | |

FOREIGN PATENT DOCUMENTS

| | | |
|---|---|---|
| EP | 1 143 147 | 10/2001 |
| GB | 2 203 268 | 10/1988 |
| JP | 6-72135 | 3/1994 |
| JP | 2523139 | 5/1996 |
| JP | 10-159746 | 6/1998 |
| JP | 11-93847 | 4/1999 |
| JP | 11-280653 | 10/1999 |
| JP | 2000-18170 | 1/2000 |
| JP | 2001-263252 | 9/2001 |
| JP | 2002-81391 | 3/2002 |
| JP | 2004-100565 | 4/2004 |

* cited by examiner

*Primary Examiner* — Devon Kramer
*Assistant Examiner* — Amene Bayou
(74) *Attorney, Agent, or Firm* — McGinn IP Law, PLLC

(57) ABSTRACT

An air compressor includes: a tank portion for reserving compressed air used in a pneumatic tool; a compressed air generation portion for generating compressed air and supplying the compressed air to the tank portion; a drive portion including a motor for driving the compressed air generation portion; a control circuit portion for controlling the drive portion; and a pressure sensor for detecting pressure of the compressed air reserved in the tank portion. The control circuit portion includes a unit for controlling the rotational speed of the motor multistageously based on a detection signal output from the pressure sensor.

23 Claims, 12 Drawing Sheets

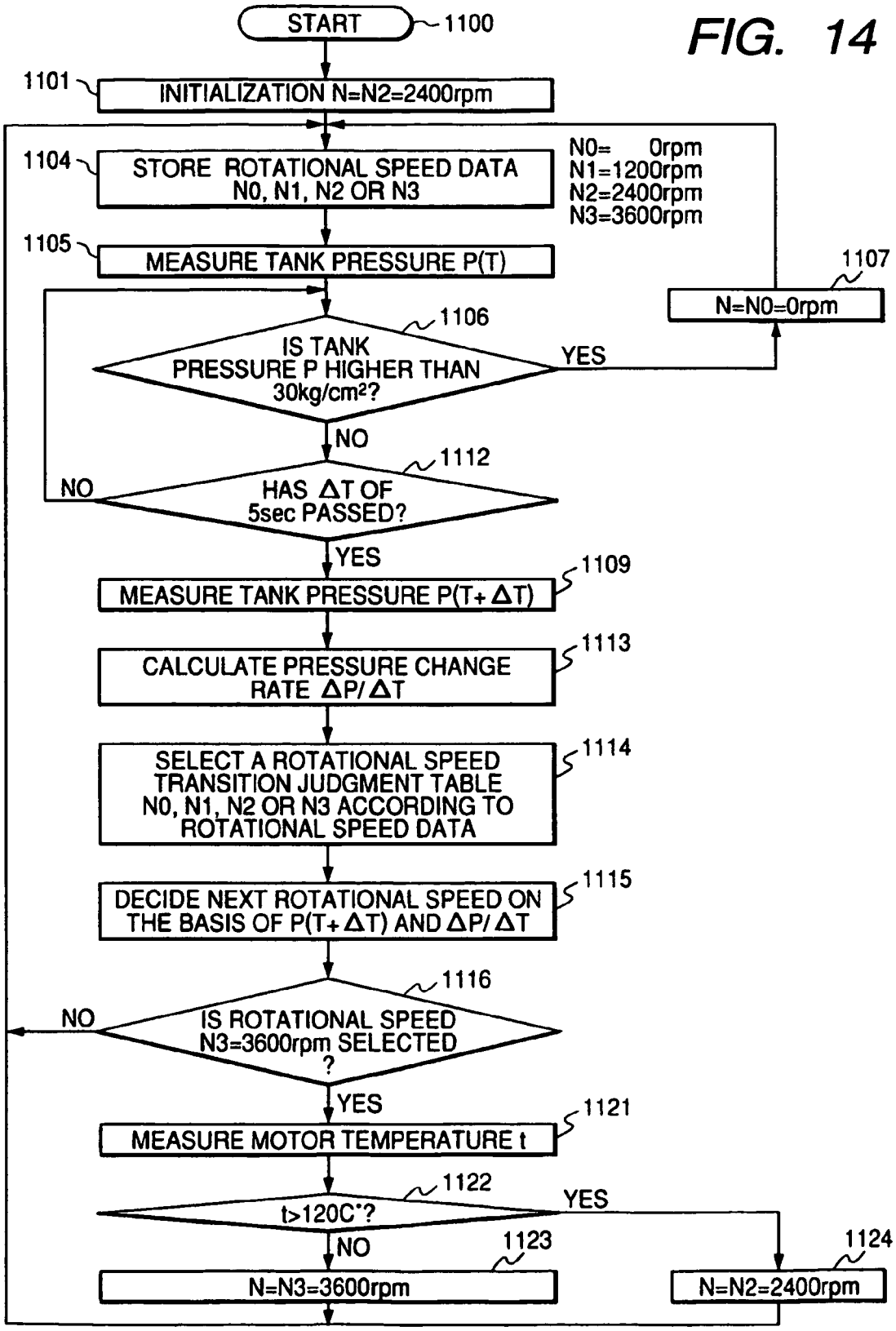
FIG. 14
START
1100
1101
INITIALIZATION N=N2=2400rpm
1104
STORE ROTATIONAL SPEED DATA N0, N1, N2 OR N3
N0= 0rpm
N1=1200rpm
N2=2400rpm
N3=3600rpm
1105
MEASURE TANK PRESSURE P(T)
1107
N=N0=0rpm
1106
IS TANK PRESSURE P HIGHER THAN 30kg/cm²?
YES
NO
1112
HAS ΔT OF 5sec PASSED?
NO
YES
1109
MEASURE TANK PRESSURE P(T+ΔT)
1113
CALCULATE PRESSURE CHANGE RATE ΔP/ΔT
1114
SELECT A ROTATIONAL SPEED TRANSITION JUDGMENT TABLE N0, N1, N2 OR N3 ACCORDING TO ROTATIONAL SPEED DATA
1115
DECIDE NEXT ROTATIONAL SPEED ON THE BASIS OF P(T+ΔT) AND ΔP/ΔT
1116
IS ROTATIONAL SPEED N3=3600rpm SELECTED ?
NO
YES
1121
MEASURE MOTOR TEMPERATURE t
1122
t>120C°?
YES
NO
1123
N=N3=3600rpm
1124
N=N2=2400rpm

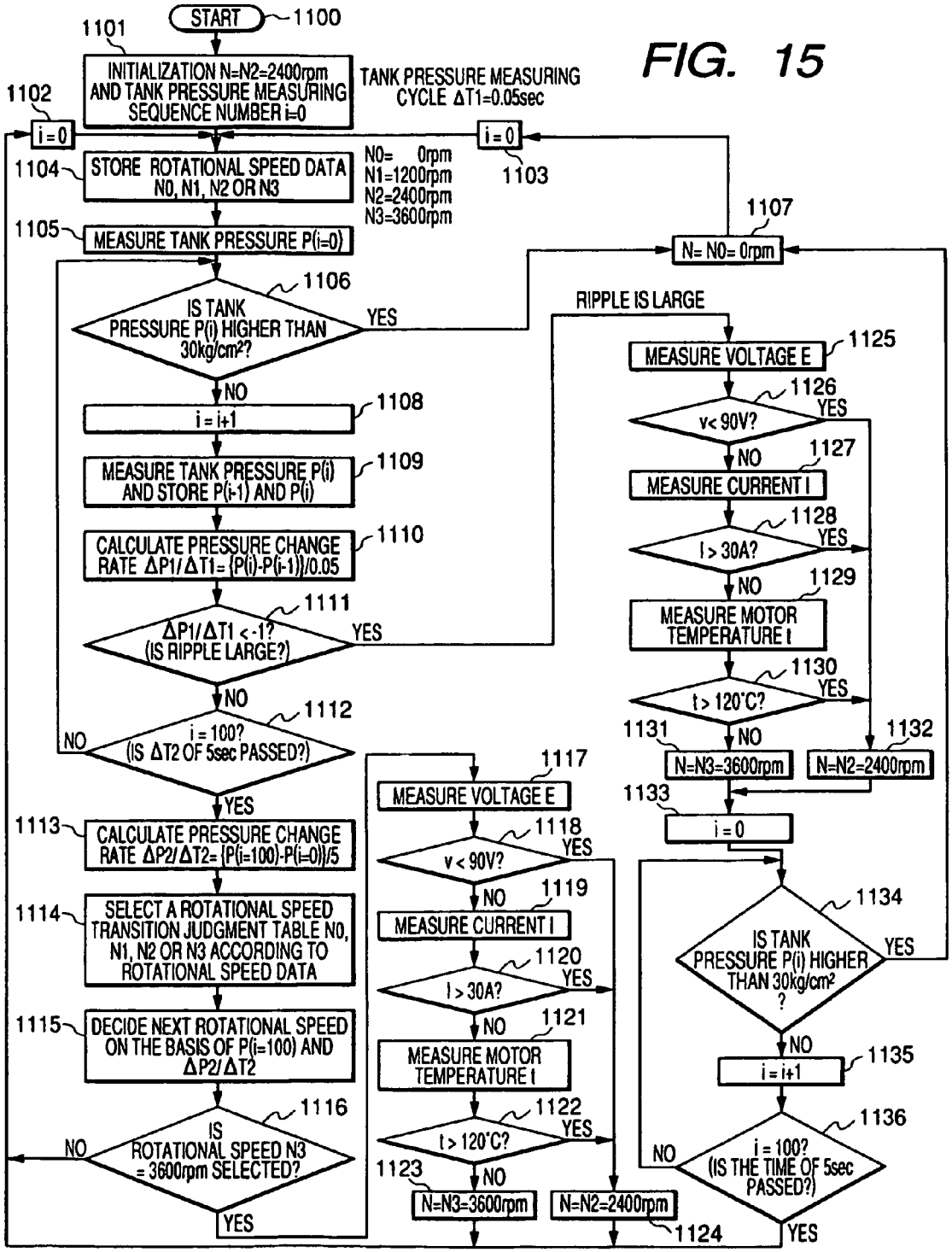
FIG. 15
START
1100
1101
INITIALIZATION N=N2=2400rpm AND TANK PRESSURE MEASURING SEQUENCE NUMBER i=0
TANK PRESSURE MEASURING CYCLE ΔT1=0.05sec
1102
i=0
1103
i=0
1104
STORE ROTATIONAL SPEED DATA N0, N1, N2 OR N3
N0= 0rpm
N1=1200rpm
N2=2400rpm
N3=3600rpm
1105
MEASURE TANK PRESSURE P(i=0)
1106
IS TANK PRESSURE P(i) HIGHER THAN 30kg/cm²?
YES
NO
1107
N= N0= 0rpm
1108
i=i+1
1109
MEASURE TANK PRESSURE P(i) AND STORE P(i-1) AND P(i)
1110
CALCULATE PRESSURE CHANGE RATE ΔP1/ΔT1= {P(i)-P(i-1)}/0.05
1111
ΔP1/ΔT1 < -1? (IS RIPPLE LARGE?)
YES
NO
RIPPLE IS LARGE
1112
i = 100? (IS ΔT2 OF 5sec PASSED?)
NO
YES
1113
CALCULATE PRESSURE CHANGE RATE ΔP2/ΔT2= {P(i=100)-P(i=0)}/5
1114
SELECT A ROTATIONAL SPEED TRANSITION JUDGMENT TABLE N0, N1, N2 OR N3 ACCORDING TO ROTATIONAL SPEED DATA
1115
DECIDE NEXT ROTATIONAL SPEED ON THE BASIS OF P(i=100) AND ΔP2/ΔT2
1116
IS ROTATIONAL SPEED N3 = 3600rpm SELECTED?
NO
YES
1117
MEASURE VOLTAGE E
1118
v < 90V?
YES
NO
1119
MEASURE CURRENT I
1120
I > 30A?
YES
NO
1121
MEASURE MOTOR TEMPERATURE t
1122
t > 120°C?
YES
NO
1123
N=N3=3600rpm
N=N2=2400rpm
1124
1125
MEASURE VOLTAGE E
1126
v< 90V?
YES
NO
1127
MEASURE CURRENT I
1128
I > 30A?
YES
NO
1129
MEASURE MOTOR TEMPERATURE t
1130
t > 120°C?
YES
NO
1131
N=N3=3600rpm
1132
N=N2=2400rpm
1133
i = 0
1134
IS TANK PRESSURE P(i) HIGHER THAN 30kg/cm² ?
YES
NO
1135
i=i+1
1136
i = 100? (IS THE TIME OF 5sec PASSED?)
NO
YES

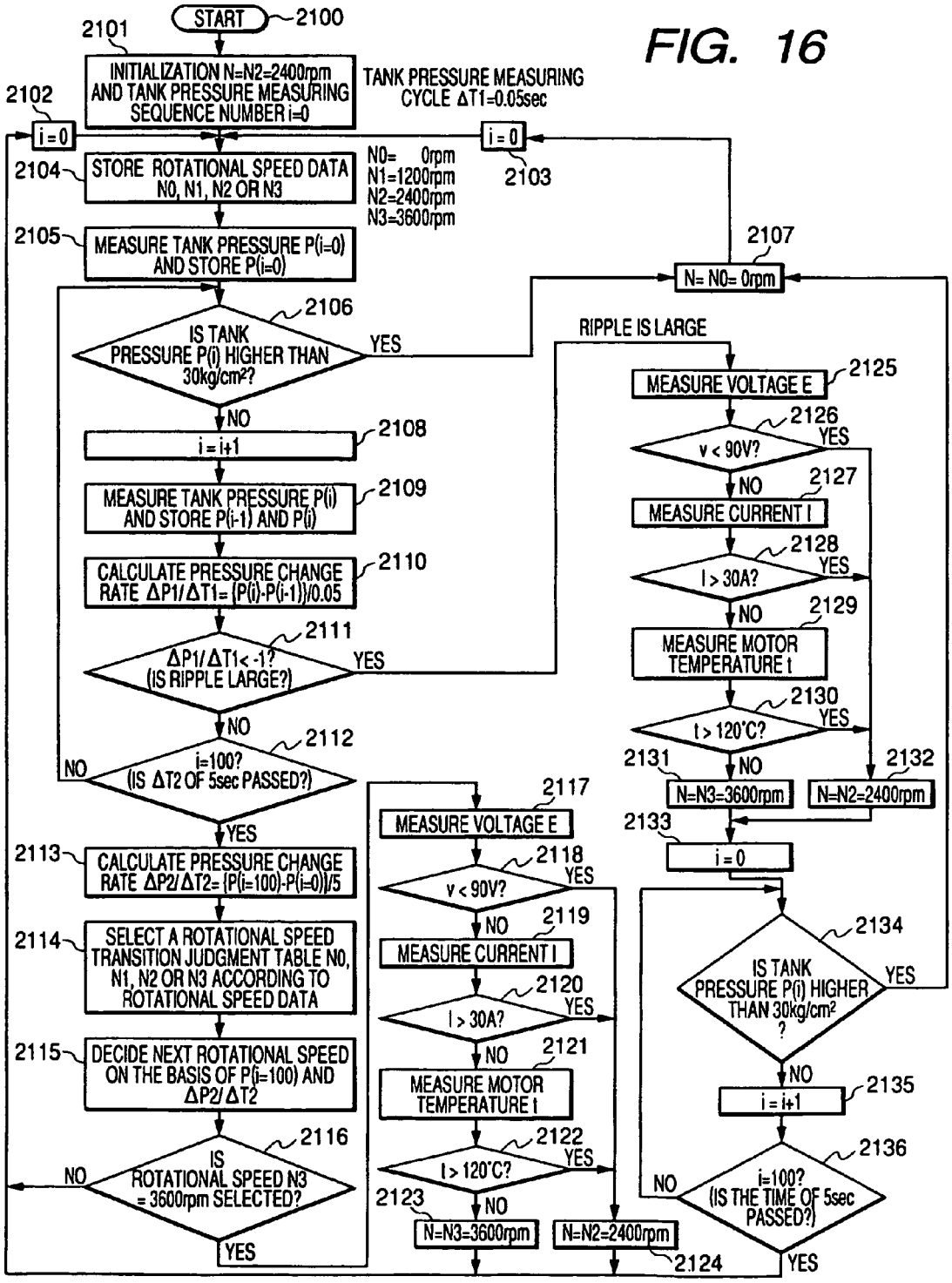
FIG. 16
START
2100
2101
INITIALIZATION N=N2=2400rpm AND TANK PRESSURE MEASURING SEQUENCE NUMBER i=0
TANK PRESSURE MEASURING CYCLE ΔT1=0.05sec
2102
i = 0
i = 0
2103
2104
STORE ROTATIONAL SPEED DATA N0, N1, N2 OR N3
N0= 0rpm
N1=1200rpm
N2=2400rpm
N3=3600rpm
2105
MEASURE TANK PRESSURE P(i=0) AND STORE P(i=0)
2107
N= N0= 0rpm
2106
IS TANK PRESSURE P(i) HIGHER THAN 30kg/cm²?
YES
NO
2108
i = i+1
2109
MEASURE TANK PRESSURE P(i) AND STORE P(i-1) AND P(i)
2110
CALCULATE PRESSURE CHANGE RATE ΔP1/ΔT1= {P(i)-P(i-1)}/0.05
2111
ΔP1/ΔT1< -1? (IS RIPPLE LARGE?)
YES
NO
2112
i=100? (IS ΔT2 OF 5sec PASSED?)
NO
YES
2113
CALCULATE PRESSURE CHANGE RATE ΔP2/ΔT2= {P(i=100)-P(i=0)}/5
2114
SELECT A ROTATIONAL SPEED TRANSITION JUDGMENT TABLE N0, N1, N2 OR N3 ACCORDING TO ROTATIONAL SPEED DATA
2115
DECIDE NEXT ROTATIONAL SPEED ON THE BASIS OF P(i=100) AND ΔP2/ΔT2
2116
IS ROTATIONAL SPEED N3 = 3600rpm SELECTED?
NO
YES
RIPPLE IS LARGE
2125
MEASURE VOLTAGE E
2126
v < 90V?
YES
NO
2127
MEASURE CURRENT I
2128
I > 30A?
YES
NO
2129
MEASURE MOTOR TEMPERATURE t
2130
t > 120°C?
YES
NO
2131
N=N3=3600rpm
2132
N=N2=2400rpm
2133
i = 0
2134
IS TANK PRESSURE P(i) HIGHER THAN 30kg/cm² ?
YES
NO
2135
i = i+1
2136
i=100? (IS THE TIME OF 5sec PASSED?)
NO
YES
2117
MEASURE VOLTAGE E
2118
v < 90V?
YES
NO
2119
MEASURE CURRENT I
2120
I > 30A?
YES
NO
2121
MEASURE MOTOR TEMPERATURE t
2122
t > 120°C?
YES
NO
2123
N=N3=3600rpm
N=N2=2400rpm
2124

AIR COMPRESSOR AND METHOD FOR CONTROLLING THE SAME

CROSS-REFERENCE TO RELATED APPLICATIONS

The present application is a Continuation application of U.S. patent application Ser. No. 10/780,876 filed on Feb. 19, 2004 now U.S. Pat. No. 7,704,052. The present application is based on and claims priority to Japanese patent application No. 2003-093933 filed on Mar. 31, 2003, Japanese patent application No. 2003-109767 filed on Apr. 15, 2003, and Japanese patent application No. 2003-109888 filed on Apr. 15, 2003, the entire contents of which are incorporated herein by reference.

BACKGROUND OF THE INVENTION

1. Field of the Invention

The present invention relates to an air compressor for generating compressed air used in a pneumatic tool such as a pneumatic nailing machine, and a method for controlling the air compressor.

2. Background Art

Generally, an air compressor used for pneumatic tool is configured so that a crankshaft of a compressor body is driven to rotate by a motor to reciprocate a piston in a cylinder in accordance with the rotation of the crankshaft to thereby compress air sucked in from an inlet valve. The compressed air generated in the compressor body is discharged from an outlet valve to an air tank through a pipe and reserved in the tank. The pneumatic tool does its work such as nailing by using the compressed air reserved in the tank.

The air compressor is often carried to a building site and used outdoors or is often used in a densely populated place. For this reason, the air compressor needs to be improved from various viewpoints. According to the present inventors' investigation into how the air compressor is actually used on the work site, users' demands and technical problems can be collected into the following items.

(1) Reduction of Noise

Because the air compressor has a mechanism for converting the rotation of the motor into the reciprocating motion of the piston in the cylinder, it is unavoidable that considerable noise is produced when the motor is rotating. Furthermore, because the pneumatic tool such as a nailing machine using compressed air generated by the air compressor produces operating noise when the pneumatic tool is operating, the operating noise is combined with the air compressor's own noise so that considerable noise is produced around the building site. Particularly when the air compressor is used in the early morning or after the evening in a densely populated place, there is a strong demand that the noise should be as low as possible.

(2) Improvement in Power and Efficiency

The place where the air compressor is used is not always in a sufficient electric power environment. The air compressor may be rather used in such an environment that it is impossible to keep a sufficiently high voltage because a long cord needs to be used for providing a power-supply voltage from another place, or in such an environment that a great deal of compressed air must be consumed because a large number of pneumatic tools need to be used simultaneously.

For this reason, it may be impossible to produce a high-power output from the air compressor. If, for example, a nailing machine is used in the condition that the output is insufficient, nailing is performed shallowly and there arises a problem that it is impossible to nail a workpiece sufficiently.

Generally, 26 kg/cm$^2$ to 30 kg/cm$^2$ of air are reserved in the air tank of the air compressor. It is unavoidable that the air leaks little by little when there is no tool used. There is another problem that lowering of efficiency may be brought about in accordance with how to use the air compressor.

(3) Improvement in Size Reduction and Portability

It is rare that the air compressor for pneumatic tool is used as a stationary type compressor. In most cases, the air compressor is of a portable type, so that the air compressor is used after carried to a building site. Therefore, the air compressor needs to be as small in size as possible and as excellent in portability as possible. Accordingly, complicating the configuration of the compressed air generation portion and the drive portion for driving the compressed air generation portion must be avoided to the utmost in order not to spoil portability.

(4) Prolongation of Life

There is a problem that the life of the air compressor used for pneumatic tool is shorter than the life of a compressor used for refrigerator, air-conditioner, etc. Although it is unavoidable in one aspect that the air compressor is short-lived because the air compressor is used in a harsh environment, suppression of change in load to the utmost or suppression of generation of wasteful compressed air to the utmost is required for attaining prolongation of the life.

(5) Suppression of Increase in Temperature

It is unavoidable that the temperature of the air compressor becomes considerably high because of the reciprocating motion of the piston in the cylinder and the electric current flowing in the motor for driving the piston. The high temperature of the air compressor, however, causes increase in loss and disturbance of efficiency. Therefore, suppression of increase in temperature of the air compressor to the utmost is required eagerly.

SUMMARY OF THE INVENTION

An exemplary object of the invention is to provide an air compressor and a controlling method thereof to solve the problems described above, specifically (1), (2) and (5).

To achieve the foregoing exemplary object, the invention provides an air compressor including a tank portion for reserving compressed air used in a pneumatic tool, a compressed air generation portion for generating compressed air and supplying the compressed air to the tank portion, a drive portion having a motor for driving the compressed air generation portion, and a control circuit portion for controlling the drive portion, wherein: the air compressor further includes a pressure sensor for detecting pressure of the compressed air reserved in the tank portion; and the control circuit portion includes a unit for controlling the rotational speed of the motor multistageously on the basis of a detection signal output from the pressure sensor.

When the rotational speed of the motor is controlled multistageously in this manner according to the tank pressure, the state of load can be predicted so that compressed air can be generated efficiently. Shortage of power can be prevented even in the case where a large amount of air is used. The rotational speed can be reduced to achieve a low-noise operation when a small amount of air is used.

In the invention, the control circuit portion may calculate internal pressure P of the tank portion on the basis of a detection signal output from the pressure sensor, calculate the rate $\Delta P/\Delta T$ of pressure change $\Delta P$ to predetermined time $\Delta T$ and decide the rotational speed of the motor on the basis of at least one of the pressure P and the rate ΔP/ΔT of pressure change.

In this configuration, the amount of air to be used can be predicted more delicately, so that the power-improving and noise-reducing effect can be improved more greatly.

In the invention, the control circuit portion may further include a memory for storing information indicating relations among the pressure P of the tank portion, the rate ΔP/ΔT of pressure change and the rotational speed of the motor, so that the rotational speed of the motor is decided by means of searching the memory.

In this configuration, the rotational speed can be controlled more easily.

In the invention, the rotational speed of the motor may be set multistageously to have a plurality of values such as 0, N, 2N, 3N, . . . , and nN (in which n is an arbitrary number), so that one of the values is selected by the control circuit portion to thereby control the motor. When the rotational speed is controlled multistageously in this manner, efficiency in generation of compressed air can be improved compared with the related-art on/off control.

The invention may provide an air compressor including a tank portion for reserving compressed air used in a pneumatic tool, a compressed air generation portion for generating compressed air and supplying the compressed air to the tank portion, a drive portion having a motor for driving the compressed air generation portion, and a control circuit portion for controlling the drive portion, wherein: the air compressor further includes a temperature sensor for detecting the temperature of the motor of the drive portion; and the rotational speed of the motor is controlled multistageously on the basis of a detection signal output from the temperature sensor.

The air compressor according to the invention may further includes a pressure sensor for detecting pressure of compressed air in the tank portion, wherein the rotational speed of the motor is controlled multistageously on the basis of detection signals output from the temperature sensor and the pressure sensor.

The air compressor according to the invention may further includes a voltage detection circuit for detecting a power-supply voltage of the drive portion, and a current detection circuit for detecting a load current of the drive portion, wherein the rotational speed of the motor is controlled multistageously on the basis of the detection signal output from the temperature sensor and a detection signal output from at least one of the voltage detection circuit and the current detection circuit.

In the air compressor according to the invention, the rotational speed of the motor may be controlled in at least three stages of high speed, middle speed and low speed.

The invention may provide an air compressor including a tank portion for reserving compressed air used in a pneumatic tool, a compressed air generation portion for generating compressed air and supplying the compressed air to the tank portion, a drive portion having a motor for driving the compressed air generation portion, and a control circuit portion for controlling the drive portion, wherein: the air compressor further includes a pressure sensor for detecting pressure of the compressed air reserved in the tank portion; and the rate $\Delta P1/\Delta T1$ of change $\Delta P1$ in internal pressure of the tank portion to a relatively short time $\Delta T1$ and the rate $\Delta P2/\Delta T2$ of change $\Delta P2$ in internal pressure of the tank portion to a time $\Delta T2$ longer than the time $\Delta T1$ are calculated on the basis of detection signals output from the pressure sensor so that the rotational speed of the motor multistageously is controlled on the basis of at least one of the two pressure change rates.

The air compressor according to the invention may further includes a temperature sensor for detecting the temperature of the motor, wherein the rotational speed of the motor is controlled multistageously on the basis of the two pressure change rates and a detection signal output from the temperature sensor.

The air compressor according to the invention may further includes a voltage sensor for detecting a power-supply voltage of the drive portion, and a current sensor for detecting a load current of the drive portion, wherein the rotational speed of the motor is controlled multistageously on the basis of the two pressure change rates and at least one of detection signals output from the voltage sensor and the current sensor.

Other features of the invention will be understood more clearly from the following description.

BRIEF DESCRIPTION OF THE DRAWINGS

The present invention may be more readily described with reference to the accompanying drawings:

FIG. 14 is a flow chart showing a second embodiment of a program used for controlling the air compressor according to the invention.

FIG. 15 is a flow chart showing another example of the second embodiment of the program used for controlling the air compressor according to the invention.

FIG. 16 is a flow chart showing a third embodiment of a program used for controlling the air compressor according to the invention.

DETAILED DESCRIPTION OF EXEMPLARY EMBODIMENTS

The First Exemplary Embodiment

A first exemplary embodiment of the invention will be described below in detail.

Figure 1:
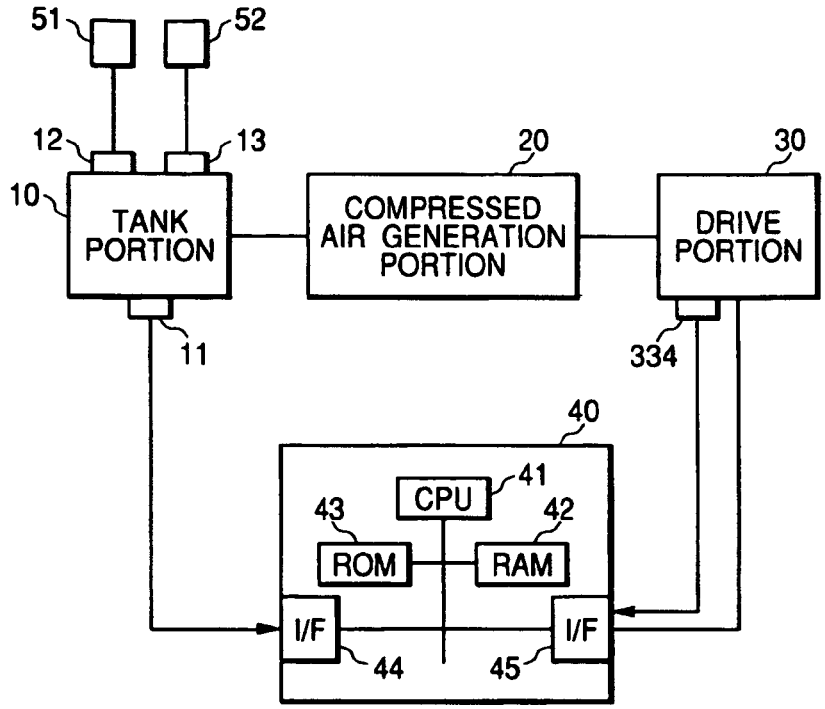
FIG. 1 is a conceptual diagram showing first to third embodiments of air compressors according to the invention.

FIG. 1 is a conceptual view of an air compressor according to the invention. As shown in FIG. 1, the air compressor includes a tank portion 10 for reserving compressed air, a compressed air generation portion 20 for generating compressed air, a drive portion 30 for driving the compressed air generation portion 20, and a control circuit portion 40 for controlling the drive portion 30.

(1) Tank Portion 10

Figure 2:
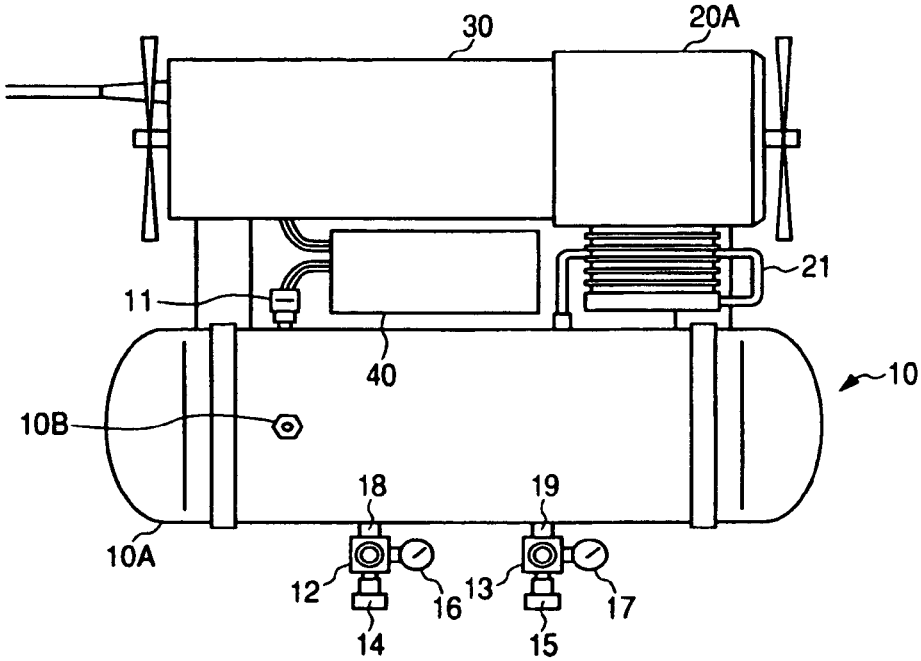
FIG. 2 is a top view showing the first embodiment of the air compressor according to the invention.

As shown in FIG. 2, the tank portion 10 includes an air tank 10A for reserving high-pressure compressed air. For example, 20 kg/cm$^2$ to 30 kg/cm$^2$ of high-pressure compressed air are supplied to the air tank 10A through a pipe 21 connected to an outlet port of a compressor portion 20A.

The air tank 10A is generally provided with a plurality of compressed air output ports 18 and 19. In this embodiment, there is shown an example in which an output port 18 for taking out low-pressure compressed air and an output port 19 for taking out high-pressure compressed air are attached to the air tank 10A. It is a matter of course that the invention is not limited to this example.

The low-pressure compressed air output port 18 is connected to a low-pressure coupler 14 through a pressure-reducing valve 12. The maximum pressure of compressed air on the outlet side of the pressure-reducing valve 12 is decided regardless of the pressure of compressed air on the inlet side of the pressure-reducing valve 12. In this embodiment, the maximum pressure is set at a predetermined value in a range of from 7 kg/cm$^2$ to 10 kg/cm$^2$. Accordingly, compressed air having a pressure of not higher than the maximum pressure can be obtained from the outlet side of the pressure-reducing valve 12 regardless of the pressure in the air tank 10A.

Compressed air on the outlet side of the pressure-reducing valve 12 is supplied to a low-pressure pneumatic tool 51 shown in FIG. 1, through the low-pressure coupler 14.

On the other hand, the high-pressure compressed air output port 19 is connected to a high-pressure coupler 15 through a pressure-reducing valve 13. The maximum pressure of compressed air on the outlet side of the pressure-reducing valve 13 is decided regardless of the pressure of compressed air on the inlet side of the pressure-reducing valve 13. In this embodiment, the maximum pressure is set at a predetermined value in a range of from 10 kg/cm$^2$ to 30 kg/cm$^2$. Accordingly, compressed air having a pressure of not higher than the maximum pressure can be obtained from the outlet side of the pressure-reducing valve 13. Compressed air on the outlet side of the pressure-reducing valve 13 is supplied to a high-pressure pneumatic tool 52 shown in FIG. 1, through the high-pressure coupler 15.

A low-pressure pressure gauge 16 and a high-pressure pressure gauge 17 are formed to be attached to the pressure-reducing valves 12 and 13 respectively so that the pressure of compressed air on the outlet side of each of the pressure-reducing valves 12 and 13 can be monitored. The low-pressure coupler 14 and the high-pressure coupler 15 are formed so as to be incompatible with each other because of difference in size, so that the high-pressure pneumatic tool 52 cannot be connected to the low-pressure coupler 14 while the low-pressure pneumatic tool 51 cannot be connected to the high-pressure coupler 15. Such a configuration has been already proposed in JP-A-4-296505 applied by the present applicant of the invention.

A pressure sensor 11 is attached to a portion of the air tank 10A so that the pressure of compressed air in the tank 10A is detected by the pressure sensor 11. A detection signal output from the pressure sensor 11 is supplied to the control circuit portion 40 and used for controlling a motor which will be described later. A safety valve 10B is attached to a portion of the air tank 10A so that part of air is leaked out of the air tank 10A through the safety valve 10B to guarantee safety when the pressure in the air tank 10A is extraordinarily high.

(2) Compressed Air Generation Portion 20

The compressed air generation portion 20 reciprocates a piston in a cylinder to compress air sucked in the cylinder through an inlet valve of the cylinder to thereby generate compressed air. The compressor per se is known. For example, JP-A-11-280653 applied by the applicant of the invention has disclosed a mechanism for transmitting the rotation of a motor to an output shaft through a pinion provided at a front end of a rotor shaft and a gear engaged with the pinion to move the output shaft to thereby reciprocate a piston.

When the piston makes reciprocating motion in the cylinder, air sucked in through the inlet valve provided in a cylinder head is compressed. When the pressure of compressed air reaches a predetermined value, compressed air is obtained from an outlet valve provided in the cylinder head. The compressed air is supplied to the air tank 10A through the pipe 21 shown in FIG. 2.

(3) Drive Portion 30

Figure 3:
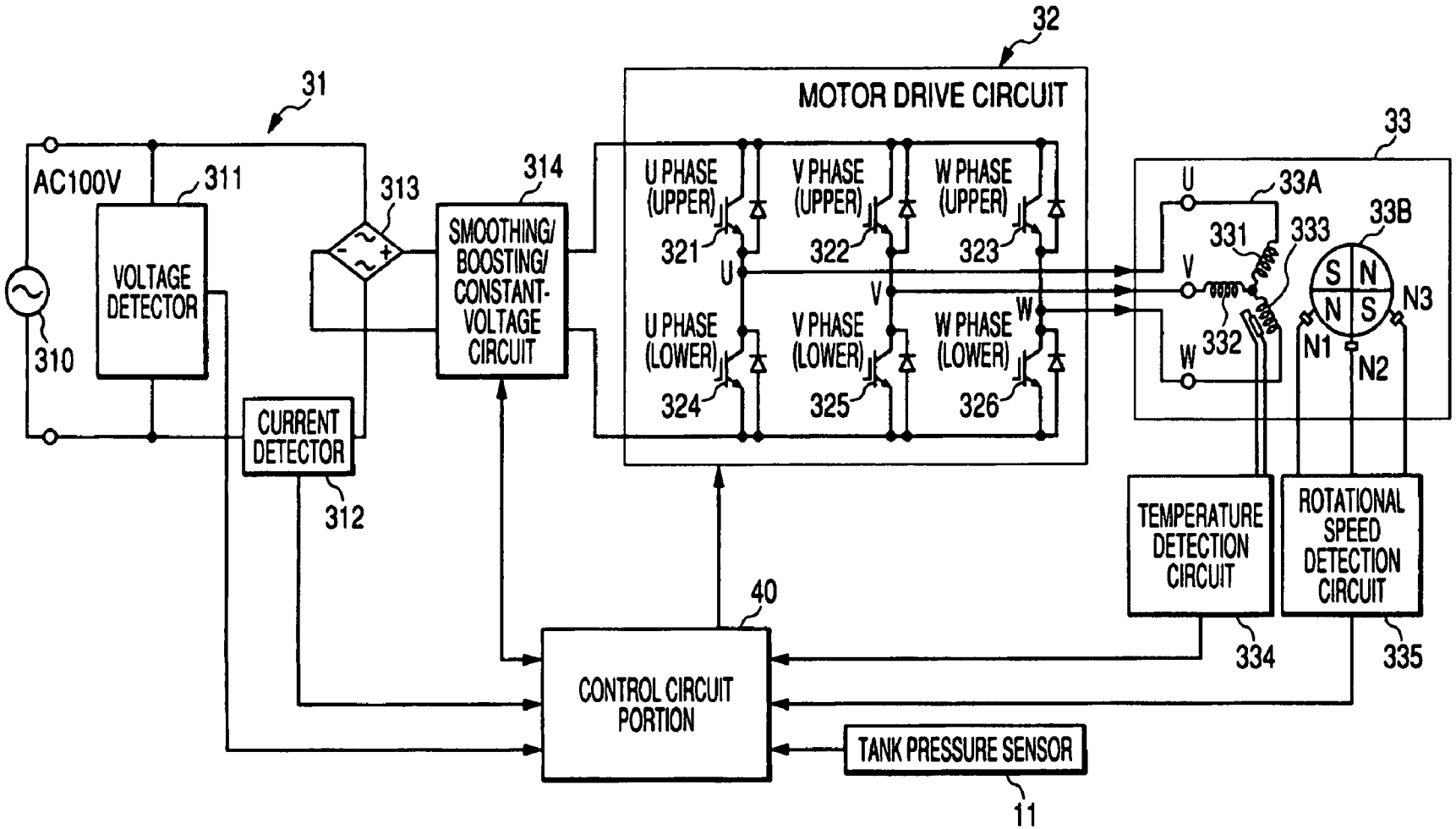
FIG. 3 is a circuit diagram showing first to third embodiments of motor drive circuits in the air compressors according to the invention.

The drive portion 30 generates drive force for reciprocating the piston. As shown in FIG. 3, the drive portion 30 includes a motor 33, a motor drive circuit 32, and a power supply circuit 31. The power supply circuit 31 has a rectifier circuit 313 for rectifying the voltage of a 100 V AC source 310, and a smoothing/boosting/constant-voltage circuit 314 for smoothing, boosting and regulating the rectified voltage into a constant voltage.

The power supply circuit 31 is also provided with a voltage detector 311 for detecting the voltage between opposite ends of the AC source 310 and a current detector 312 for detecting the current flowing in the AC source 310, if necessary. Signals output from the detectors 311 and 312 are supplied to the control circuit portion 40 which will be described later. Although the detectors 311 and 312 are used for controlling the motor 33 to rotate at a super-high speed, for example, in such a very short time that a circuit breaker (not shown) of the AC source 310 is not operated, detailed description of the detectors 311 and 312 will be omitted because the detectors 311 and 312 are not directly concerned with controlling in this embodiment. Although the control circuit portion 40 is also concerned with the constant-voltage circuit 314 for obtaining a constant voltage, detailed description of the constant-voltage circuit 314 will be omitted because the configuration of the constant-voltage circuit 314 per se is commonly known.

The motor drive circuit 32 has switching transistors 321 to 326 for generating a three-phase pulse voltage of U phase, V phase and W phase from a DC voltage. The transistors 321 to 326 are controlled to be switched on/off by the control circuit portion 40. The frequency of a pulse signal supplied to each of the transistors 321 to 326 is controlled to thereby control the rotational speed of the motor.

As an example, the rotational speed N of the motor 33 is set multistageously to be integral multiples nR of a reference value R, such as 0 rpm, 1200 rpm, 2400 rpm and 3600 rpm.

The motor 33 is controlled to be driven at a rotational speed selected from these values.

Diodes are connected in parallel with the switching transistors 321 to 326 respectively. The diodes are provided for preventing the transistors 321 to 326 from being destroyed by counter electromotive force generated in a stator 33A of the motor 33.

The motor 33 has a stator 33A, and a rotor 33B. U-phase, V-phase and W-phase coils 331, 332 and 333 are formed in the stator 33A. A rotating magnetic field is formed based on electric currents flowing in these coils 331 to 333.

In this embodiment, the rotor 33B is made of a permanent magnet. The rotor 33B is rotated by the rotating magnetic field formed based on electric currents flowing in these coils 331 to 333 of the stator 33A. The rotating force of the rotor 33B serves as drive force for operating the piston of the compressed air generation portion 20 (FIG. 1).

The motor 33 is provided with a temperature detection circuit 334 for detecting the coil temperature of the stator 33A. A detection signal output from the temperature detection circuit 334 is supplied to the control circuit portion 40. The motor 33 is also provided with a rotational speed detection circuit 335 for detecting the rotational speed of the rotor 33B, if necessary. A detection signal output from the rotational speed detection circuit 335 is supplied to the control circuit portion 40.

(4) Control Circuit Portion 40

As shown in FIG. 1, the control circuit portion 40 includes a central processing unit (hereinafter abbreviated to CPU) 41, a random access memory (hereinafter abbreviated to RAM) 42, and a read-only memory (hereinafter abbreviated to ROM) 43.

A detection signal output from the pressure sensor 11 and a detection signal output from the temperature detection circuit 334 are supplied to the CPU 41 through interface circuits (hereinafter abbreviated to I/F circuits) 44 and 45 respectively. A command signal output from the CPU 41 is supplied to the motor drive circuit 32 of the drive portion 30 through the I/F circuit 45 to thereby control the switching transistors 321 to 326 (FIG. 3).

Figure 4:
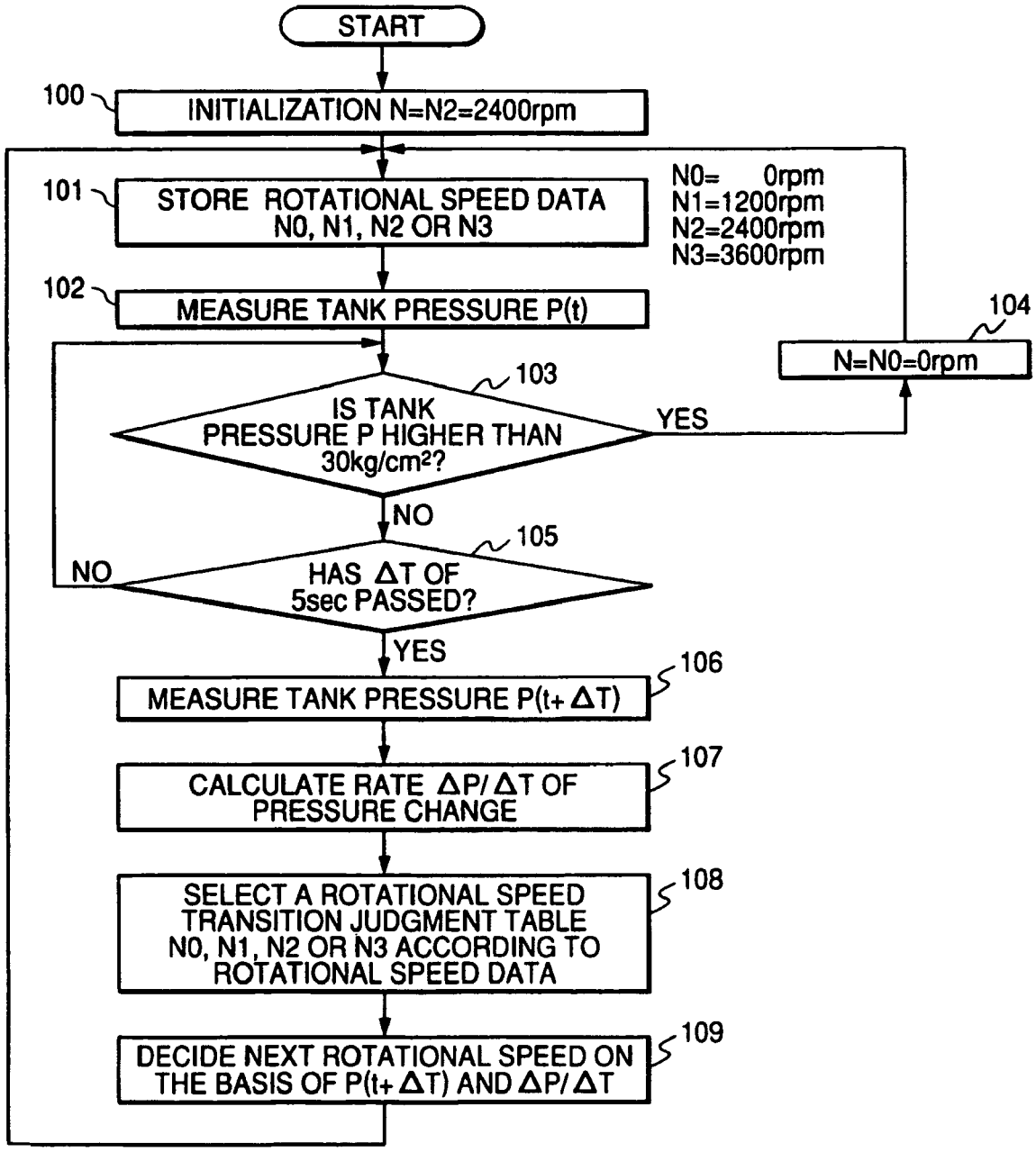
FIG. 4 is a flow chart showing a first embodiment of a program used for controlling the air compressor according to the invention.

A motor control program as shown in FIG. 4 is stored in the ROM 43. The RAM 42 is used for temporarily storing data and calculation results necessary for execution of the program.

(5) Control Program

FIG. 4 is a flow chart of the program stored in the ROM 43 of the control circuit portion 40 in the invention.

In step 100 in FIG. 4, initialization is performed so that the rotational speed of the motor 33 is set at N2 (2400 rpm). In next step 101, when step 109 requests the rotational speed to change as will be described later, the changed rotational speed is retrieved from tables stored in the RAM 42 of the control circuit portion 40 and the set value is changed. This embodiment shows an example in which the rotational speed N of the motor 33 is controlled in four stages, that is, N0, N1, N2 and N3. The rotational speed N of the motor 33 can be controlled to have each value of N0=0 rpm, N1=1200 rpm, N2=2400 rpm and N3=3600 rpm. It is a matter of course that the invention is not limited to the specific example. The rotational speed N can be controlled multistageously. The values of N0, N1, N2 and N3 can be set optionally.

In step 102, the pressure P(t) of compressed air in the air tank 10A is detected by the pressure sensor 11 (FIG. 2). The pressure P(t) is suitably A/D-converted in the control circuit portion 40 and stored in a region in the RAM 42.

In next step 103, a judgment is made as to whether the pressure P in the tank 10A is higher than 30 kg/cm$^2$ or not. When the pressure P in the tank 10A is higher than 30 kg/cm$^2$, the current position of the program goes to step 104 in which the motor 33 is controlled to stop its rotation. That is, because this embodiment is designed so that the pressure in the air tank 10A is controlled to be kept in a range of from 26 kg/cm$^2$ to 30 kg/cm$^2$, the rotation of the motor 33 is stopped to interrupt the operation of the compressed air generation portion 20 when the pressure in the air tank 10A is higher than 30 kg/cm$^2$.

When the pressure P in the air tank 10A is not higher than 30 kg/cm$^2$, the current position of the program goes to step 105 in which a judgment is made as to whether the time of 5 sec ($\Delta T$=5 sec) has passed from the point of time of measurement of P(t) or not. This is not only for the purpose of detecting the pressure in the air tank 10A but also for the purpose of detecting the rate $\Delta P/\Delta T$ of pressure change. When the time $\Delta T$=5 sec has passed, the pressure $P(t+\Delta T)$ in the tank 10A is detected again and the detected value is stored in the RAM 42 of the control circuit portion 40.

In step 107, the rate $\Delta P/\Delta T$ of pressure change is calculated in the control circuit portion 40. That is, because this embodiment shows the case where the time $\Delta T$ is set at 5 sec, the difference $\Delta P=P(t+\Delta T)-P(t)$ between the tank pressure P(t) at a point of time t and the tank pressure $P(t+\Delta T)$ after the passage of $\Delta T$ is calculated, and then the rate $\Delta P/\Delta T$ is calculated. Although this embodiment shows the case where the time $\Delta T$ is set at 5 sec because the pressure in the tank 10A generally changes slowly, the value of $\Delta T$ can be suitably selected in accordance with the installation place and sensitivity of the pressure sensor 11.

Figure 5:
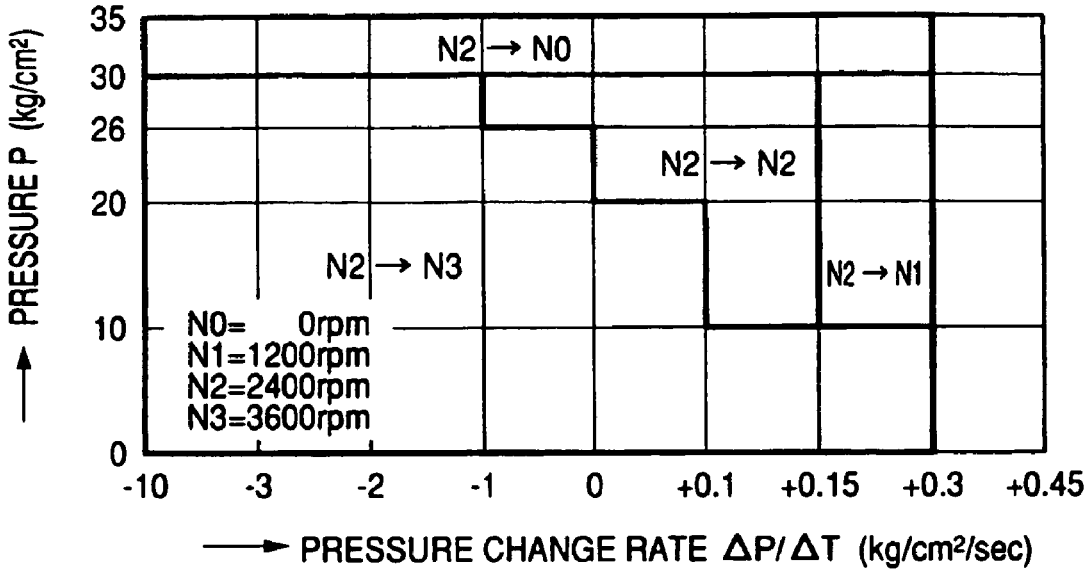
FIG. 5 is a graph for explaining a rotational speed transition judgment table used for controlling the air compressor according to the invention.
Figure 6:
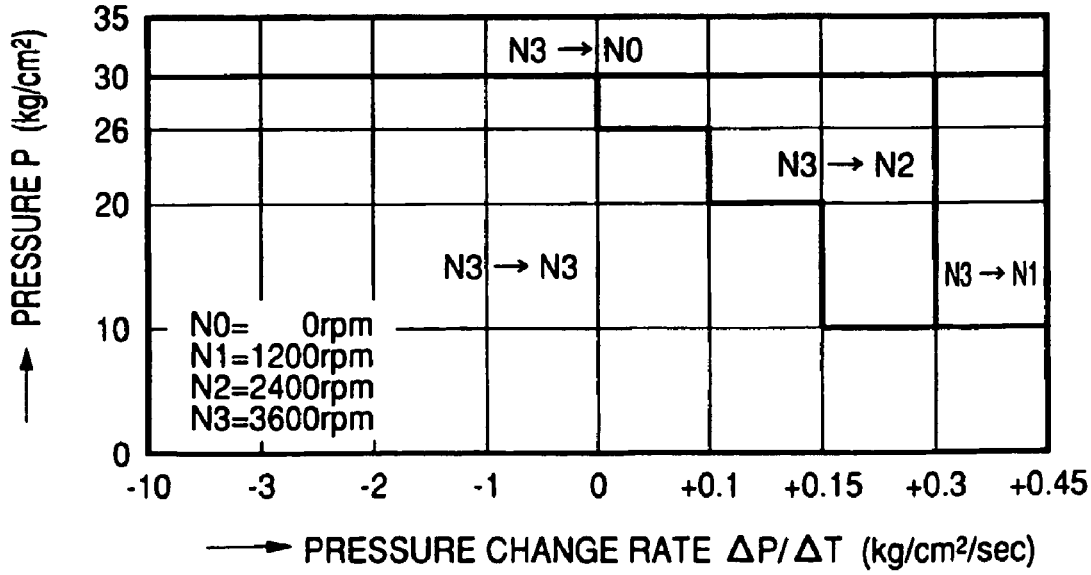
FIG. 6 is a graph for explaining a rotational speed transition judgment table used for controlling the air compressor according to the invention.
Figure 7:
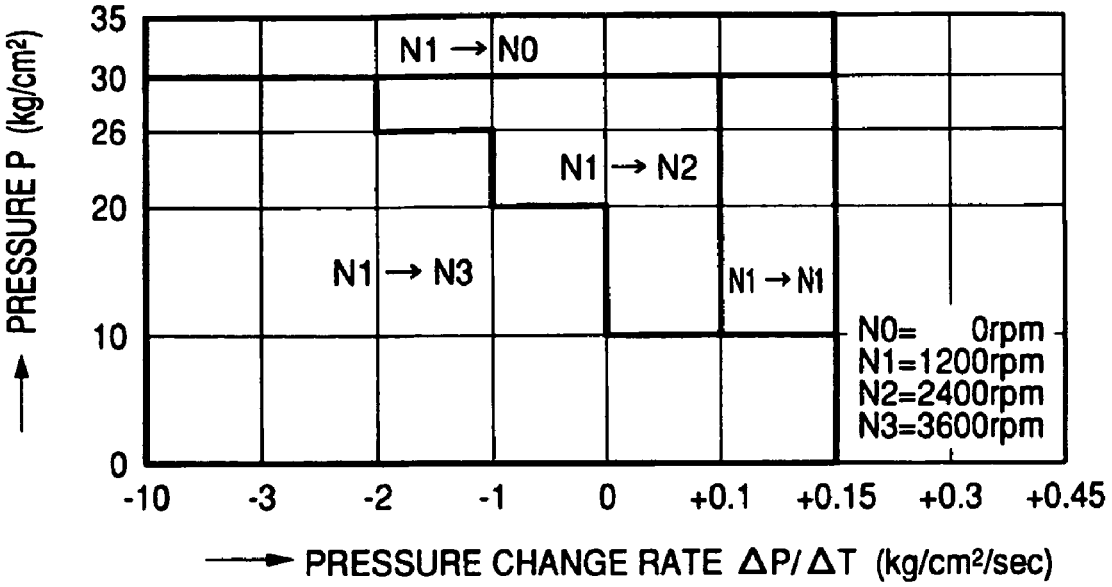
FIG. 7 is a graph for explaining a rotational speed transition judgment table used for controlling the air compressor according to the invention.
Figure 8:
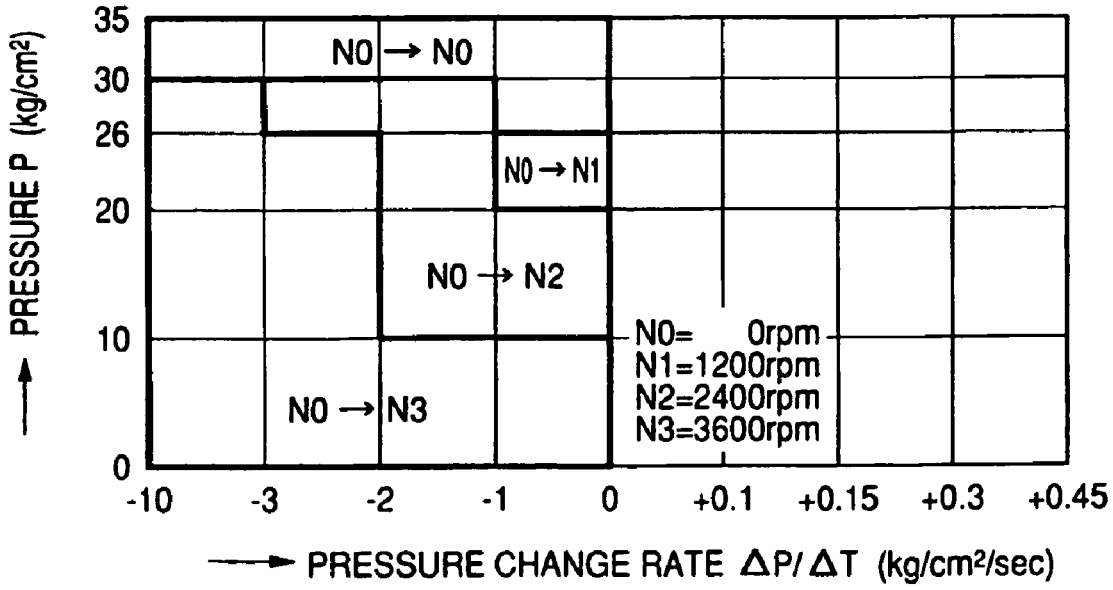
FIG. 8 is a graph for explaining a rotational speed transition judgment table used for controlling the air compressor according to the invention.

In next step 108, a rotational speed transition judgment table is selected. Four kinds of rotational speed transition judgment tables as shown in FIGS. 5, 6, 7 and 8 are stored in the RAM 42 of the control circuit portion 40 in advance. When the current rotational speed N of the motor 33 is the initial value N2 (=2400 rpm), the table shown in FIG. 5 is selected. When the current rotational speed N of the motor 33 is N3 (=3600 rpm), the table shown in FIG. 6 is selected. When the current rotational speed N of the motor 33 is N1, the table shown in FIG. 7 is selected. Similarly, when the current rotational speed N of the motor 33 is N0, the table shown in FIG. 8 is selected. In each of the tables, tank pressure P is taken in the vertical axis and pressure change rate $\Delta P/\Delta T$ of the tank pressure is taken in the horizontal axis, so that each table is used for deciding the rotational speed of the motor 33 based on the values of P and $\Delta P/\Delta T$.

Referring to FIG. 5 by way of example, when the tank pressure P is higher than 30 kg/cm$^2$, the rotational speed is set at N0 regardless of the value of $\Delta P/\Delta T$. That is, the motor is stopped. This is natural because the tank pressure is controlled to be always kept in a range of from 26 kg/cm$^2$ to 30 kg/cm$^2$.

Because the fact that the pressure change rate $\Delta P/\Delta T$ has a minus value means the fact that the amount of spent compressed air is larger than the amount of compressed air supplied to the tank 10A, controlling is made so that the current rotational speed N2 (=2400 rpm) of the motor 33 is switched over to a higher value N3 (=3600 rpm). Particularly in the case where the pneumatic tools 51 and 52 (FIG. 1) are operated fully, there is the possibility that the pressure in the tank 10A may be lowered rapidly because a large amount of compressed air is spent. In this case, therefore, when $\Delta P/\Delta T$ is not larger than −1 kg/cm$^2$/sec, the rotational speed is switched over to N3 immediately if the tank pressure P is 30 kg/cm$^2$.

However, when the pressure change rate $\Delta P/\Delta T$ is relatively small to be in a range of from −1 kg/cm$^2$/sec to 0 kg/cm$^2$/sec, the motor 33 is operated continuously at the rotational speed of N2 while the pressure P in the tank 10A is not lower than 26 kg/cm$^2$, and the rotational speed of the motor 33 is switched over to N3 when the pressure P in the tank 10A is reduced to be lower than 26 kg/cm$^2$. On the other hand, when $\Delta P/\Delta T$ is in a range of from 0 kg/cm$^2$/sec to +0.1 kg/cm$^2$/sec, that is, when the amount of supplied compressed air is slightly larger than the amount of spent compressed air, the motor 33 is operated continuously at the rotational speed of N2 while the pressure P in the tank 10A is not lower than 20 kg/cm$^2$, and the rotational speed of the motor 33 is switched over to N3 when the pressure P in the tank 10A is reduced to be lower than 20 kg/cm$^2$.

When the value of $\Delta P/\Delta T$ is in a range of from +0.1 kg/cm$^2$/sec to +0.15 kg/cm$^2$/sec, that is, when the amount of compressed air in the tank 10A is increasing, the motor 33 is operated continuously at the rotational speed of N2 while the tank pressure P is not lower than 10 kg/cm$^2$, and the rotational speed of the motor 33 is switched over to N3 when the tank pressure P is reduced to be lower than 10 kg/cm$^2$. When $\Delta P/\Delta T$ is increased to be in a range of from +0.15 kg/cm$^2$/sec to +0.3 kg/cm$^2$/sec, the rotational speed of the motor 33 is controlled to be reduced from the current value N2 to N1 if the tank pressure is not lower than 10 kg/cm$^2$ because rapid increase in the tank pressure P is predicted.

Although the description has been made on the case where the rotational speed of the motor 33 currently operating is N2 and to be changed to N0, N3 or N1, controlling is made so that the rotational speed is changed on the basis of a different pattern as shown in FIG. 6, 7 or 8 when the current rotational speed is N3, N1 or N0.

Referring back to FIG. 4, in step 109, the selected judgment table is searched to decide the rotational speed of the motor 33 on the basis of $P(t+\Delta T)$ and $\Delta P/\Delta T$. The decided rotational speed is stored in the RAM 42 in the step 101 so as to be used for controlling the motor 33.

(6) Operation

The operation of the apparatus according to the invention will be described below.

Figure 9:
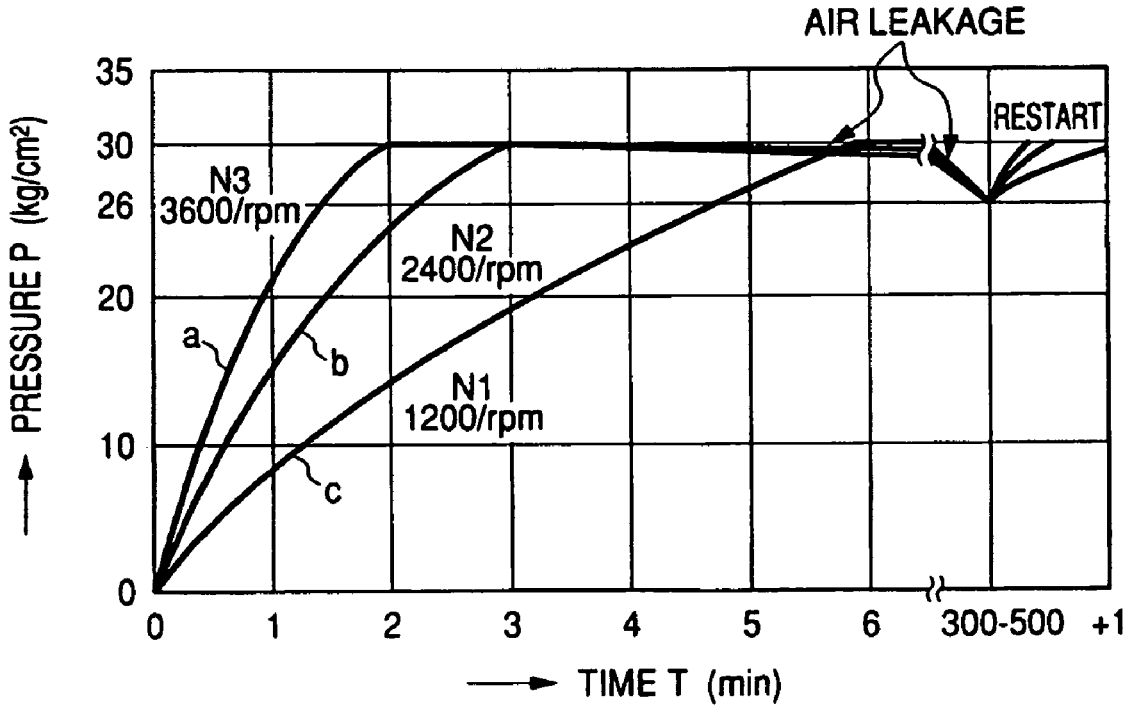
FIG. 9 is a graph of a pressure change curve for explaining the operation of a related-art air compressor.

FIG. 9 shows curves of change in the tank pressure P in the case where the rotational speed is not changed. For example, this shows a state in which there is no pneumatic tool used. In FIG. 9, the curve a expresses change in the tank pressure P in the case where the motor 33 is rotated at 3600 rpm, the curve b expresses change in the tank pressure P in the case where the motor 33 is rotated at 2400 rpm, and the curve c expresses change in the tank pressure P in the case where the motor 33 is rotated at 1200 rpm. Assume now that the set value of the rotational speed is 2400 rpm. When the motor is switched on, the tank pressure first increases according to the curve b. When a time of about 3 minutes has passed, the tank pressure P reaches 30 kg/cm$^2$ and the operation of the motor stops. If the motor is left as it is, the amount of compressed air in the tank is reduced little by little because of air leakage. When the tank pressure P is reduced to 26 kg/cm$^2$ because of the air leakage, the operation of the motor restarts. In the case of the curve a or c, the same on/off control operation is carried out so that the motor is switched off at the tank pressure P of 30 kg/cm$^2$ and switched on at the tank pressure P of 26 kg/cm$^2$.

Figure 10:
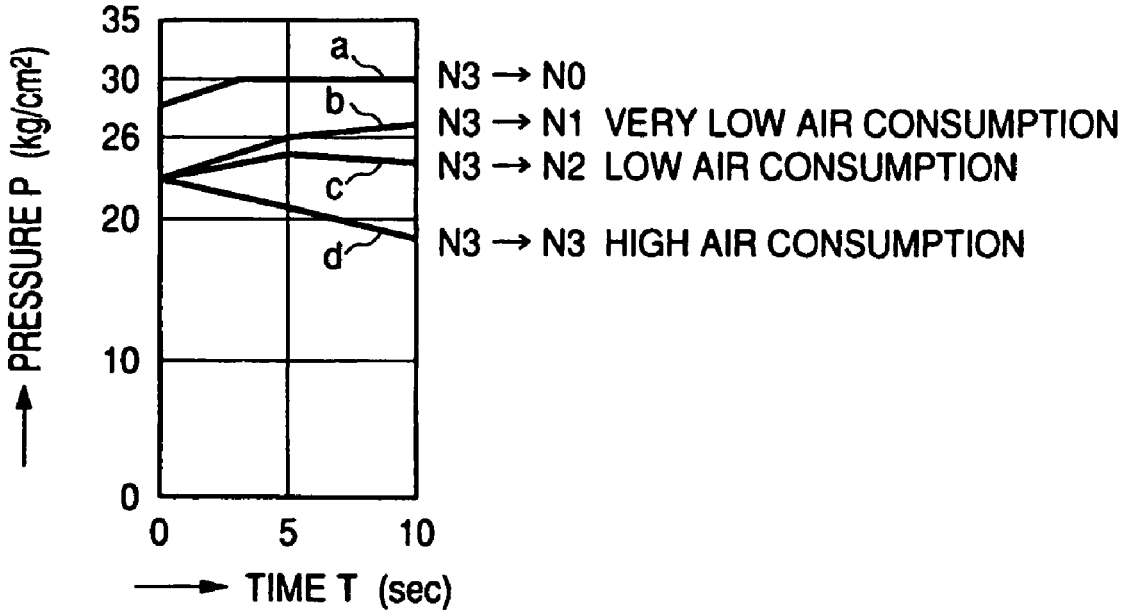
FIG. 10 is a graph of a pressure change curve for explaining the operation of the air compressor according to the invention.
Figure 11:
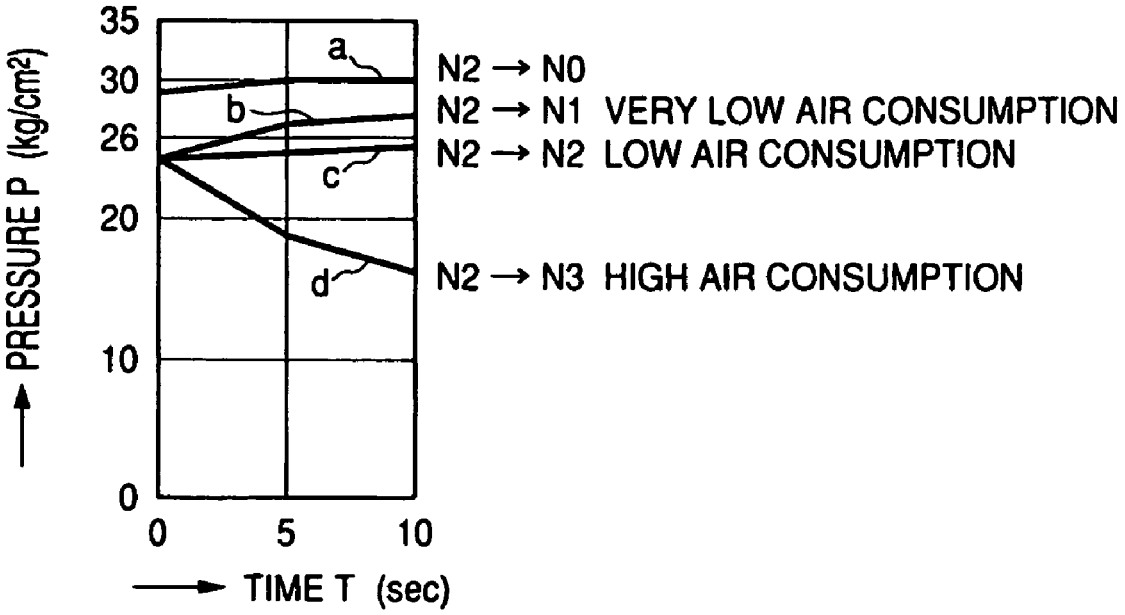
FIG. 11 is a graph of a pressure change curve for explaining the operation of the air compressor according to the invention.
Figure 12:
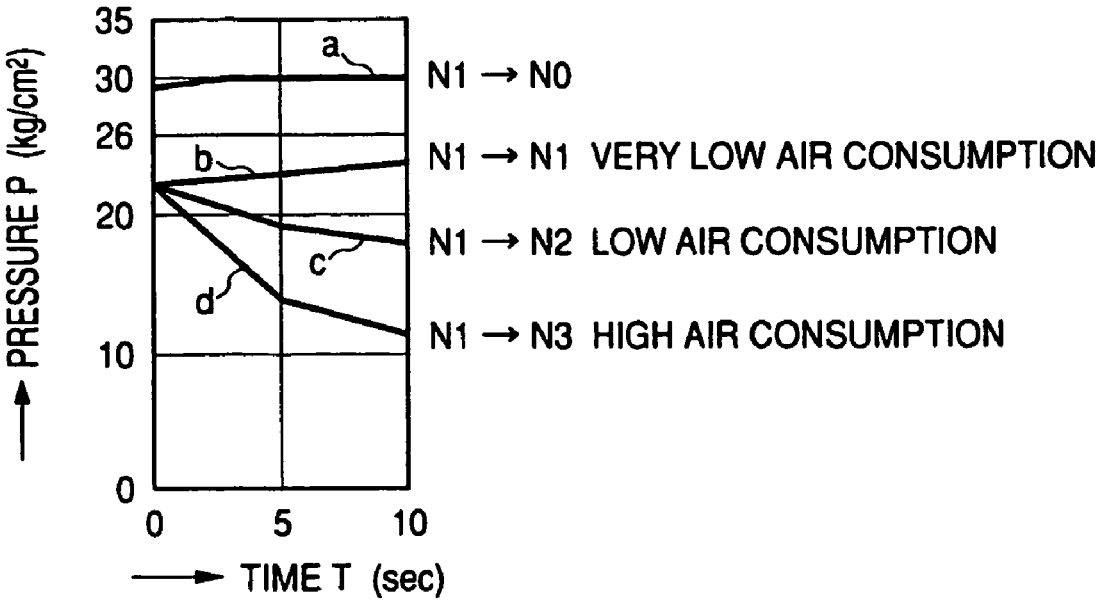
FIG. 12 is a graph of a pressure change curve for explaining the operation of the air compressor according to the invention.
Figure 13:
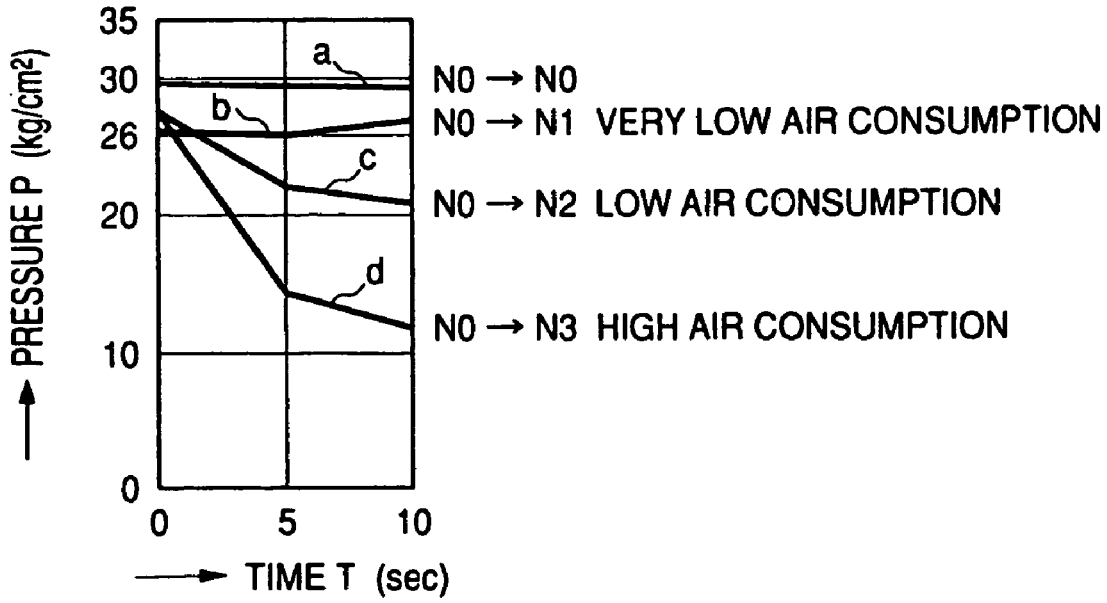
FIG. 13 is a graph of a pressure change curve for explaining the operation of the air compressor according to the invention.

FIGS. 10 to 13 are graphs for explaining rotational speed transition in the case where the rotational speed is controlled multistageously according to the invention. FIG. 10 shows the case where the rotational speed N of the motor operating at 3600 rpm is changed to another rotational speed. Similarly, each of FIGS. 11, 12 and 13 shows the case where the rotational speed N is changed from 2400 rpm, 1200 rpm or 0 rpm to another rotational speed.

Referring to FIG. 11 by way of example, when the tank pressure P changes according to the curve a in a time T of 5 sec, that is, when the tank pressure P reaches 30 kg/cm$^2$, the rotational speed N2 (2400 rpm) is switched over to N0 (0 rpm). On the other hand, when the tank pressure increases slowly according to the curve b so that a very small amount of air is spent, the rotational speed N2 is switched over to N1 (1200 rpm) so that the rate of increase in the pressure P is low.

When change in the tank pressure in the time T of 5 sec is very low as shown in the curve c so that a small amount of air is spent, the rotational speed is kept at N2 so that the pressure P is kept in a very low change state.

When a large amount of air is spent in the time T of 5 sec as shown in the curve d so that the tank pressure P is reduced rapidly, the rotational speed N2 is switched over to N3 (3600 rpm) so that the rate of decrease in the pressure P is relaxed greatly. Although the detailed description of the other cases shown in FIGS. 10, 12 and 13 will be omitted, the rotational speed is changed in accordance with the amount of spent air in the time T of 5 sec, that is, in accordance with the pressure change rate in the same manner as in the case of FIG. 11. Accordingly, even in the case where the amount of spent air varies widely every moment, rapid increase/decrease in the tank pressure can be suppressed.

As is obvious from the above description, the air compressor according to the invention is configured so that the motor is controlled on the basis of the rotational speed set multistageously on the basis of both the pressure of compressed air in the air tank and the rate of change in the compressed air. In this manner, the operation of the motor can be controlled while the amount of spent air is predicted in accordance with the load on the air compressor as well as the tank pressure is kept in a predetermined range. Accordingly, the air compressor easy to handle can be provided because the tank pressure is prevented from being reduced extremely. In addition, the time when the motor can be operated in a state of low rotational speed is prolonged because compressed air can be generated efficiently in accordance with the state of load. Accordingly, the air compressor low in noise compared with the related art can be provided.

The Second Exemplary Embodiment

A second exemplary embodiment of the invention will be described below in detail.

In this second embodiment, elements common with those of the first embodiment will be referred by the same references and the explanations for the common elements will be omitted.

The air compressor according to the second embodiment is broadly the same as that of the first embodiment shown in FIGS. 1-3, but different in the configuration of control program stored in the ROM 43 of the control circuit portion 40. Hereinbelow, the configuration of the control program according to the second embodiment and an operation of the apparatus based on the control program will be described.

(5') Control Program

FIG. 14 is a flow chart showing a second embodiment of the program stored in the ROM 43 of the control circuit portion 40 in the invention.

In step 1101 in FIG. 14, initialization is performed so that the rotational speed of the motor 33 is set at N2 (2400 rpm). In next step 1104, rotational speed data used for controlling the air compressor according to the invention is stored. This embodiment shows an example in which the rotational speed N of the motor 33 is controlled in four stages, that is, N0, N1, N2 and N3. The rotational speed N of the motor 33 can be controlled to have each value of N0=0 rpm, N1=1200 rpm, N2=2400 rpm and N3=3600 rpm. It is a matter of course that the invention is not limited to the specific example. The rotational speed N can be controlled multistageously. The values of N0, N1, N2 and N3 can be set optionally.

In step 1105, the pressure P(T) of compressed air in the air tank 10A is detected by the pressure sensor 11 (FIG. 2). The pressure P(T) is suitably A/D-converted in the control circuit portion 40 and stored in a region in the RAM 42.

In next step 1106, a judgment is made as to whether the pressure P in the tank 10A is higher than 30 kg/cm$^2$ or not. When the pressure P in the tank 10A is higher than 30 kg/cm$^2$, the current position of the program goes to step 1107 in which the motor 33 is controlled to stop its rotation. That is, because this embodiment is designed so that the pressure in the air tank 10A is controlled to be kept in a range of from 26 kg/cm$^2$ to 30 kg/cm$^2$, the rotation of the motor 33 is stopped to interrupt the operation of the compressed air generation portion 20 when the pressure in the air tank 10A is higher than 30 kg/cm$^2$.

When the pressure P in the air tank 10A is not higher than 30 kg/cm$^2$, the current position of the program goes to step 1112 in which a judgment is made as to whether the time of 5 sec ($\Delta T$=5 sec) has passed from the point of time of measurement of P(T) or not. This is not only for the purpose of detecting the pressure in the air tank 10A but also for the purpose of detecting the rate $\Delta P/\Delta T$ of pressure change. When the time $\Delta T$=5 sec has passed, the pressure P(T+$\Delta$T) in the tank 10A is detected again and the detected value is stored in the RAM 42 of the control circuit portion 40.

In step 1113, the rate $\Delta P/\Delta T$ of pressure change is calculated in the control circuit portion 40. That is, because this embodiment shows the case where the time $\Delta T$ is set at 5 sec, the difference $\Delta P$=P(T+$\Delta$T)−P(T) between the tank pressure P(T) at a point of time T and the tank pressure P(T+$\Delta$T) after the passage of $\Delta T$ is calculated, and then the rate $\Delta P/\Delta T$ is calculated. Although this embodiment shows the case where the time $\Delta T$ is set at 5 sec because the pressure in the tank 10A generally changes slowly, the value of $\Delta T$ can be suitably selected in accordance with the installation place and sensitivity of the pressure sensor 11.

In next step 1114, a rotational speed transition judgment table is selected. Four kinds of rotational speed transition tables as shown in FIGS. 5, 6, 7 and 8 are stored in the RAM 42 of the control circuit portion 40 in advance. When the current rotational speed N of the motor 33 is the initial value N2 (=2400 rpm), the table shown in FIG. 5 is selected. When the current rotational speed N of the motor 33 is N3 (=3600 rpm), the table shown in FIG. 6 is selected. When the current rotational speed N of the motor 33 is N1, the table shown in FIG. 7 is selected. Similarly, when the current rotational speed N of the motor 33 is N0, the table shown in FIG. 8 is selected. In each of the tables, tank pressure P is taken in the vertical axis and pressure change rate $\Delta P/\Delta T$ of the tank pressure is taken in the horizontal axis, so that each table is used for deciding the rotational speed of the motor 33 on the basis of the values of P and $\Delta P/\Delta T$.

Referring to FIG. 5 by way of example, when the tank pressure P is higher than 30 kg/cm$^2$, the rotational speed is set at N0 regardless of the value of $\Delta P/\Delta T$. That is, the motor is stopped. This is natural because the tank pressure is controlled to be always kept in a range of from 26 kg/cm$^2$ to 30 kg/cm$^2$.

Because the fact that the pressure change rate $\Delta P/\Delta T$ has a minus value means the fact that the amount of spent compressed air is larger than the amount of compressed air supplied to the tank 10A, controlling is made so that the current rotational speed N2 (=2400 rpm) of the motor 33 is switched over to a higher value N3 (=3600 rpm). Particularly in the case where the pneumatic tools 51 and 52 (FIG. 1) are operated fully, there is the possibility that the pressure in the tank 10A may be lowered rapidly because a large amount of compressed air is spent. In this case, therefore, when $\Delta P/\Delta T$ is not larger than −1 kg/cm$^2$/sec, the rotational speed is switched over to N3 immediately if the tank pressure P is 30 kg/cm$^2$. However, when the pressure change rate $\Delta P/\Delta T$ is relatively small to be in a range of from −1 kg/cm$^2$/sec to 0 kg/cm$^2$/sec, the motor 33 is operated continuously at the rotational speed of N2 while the pressure P in the tank 10A is not lower than 26 kg/cm$^2$, and the rotational speed of the motor 33 is switched over to N3 when the pressure P in the tank 10A is reduced to be lower than 26 kg/cm$^2$. On the other hand, when $\Delta P/\Delta T$ is in a range of from 0 kg/cm$^2$/sec to +0.1 kg/cm$^2$/sec, that is, when the amount of supplied compressed air is slightly larger than the amount of spent compressed air, the motor 33 is operated continuously at the rotational speed of N2 while the pressure P in the tank 10A is not lower than 20 kg/cm$^2$, and the rotational speed of the motor 33 is switched over to N3 when the pressure P in the tank 10A is reduced to be lower than 20 kg/cm$^2$.

When the value of $\Delta P/\Delta T$ is in a range of from +0.1 kg/cm$^2$/sec to +0.15 kg/cm$^2$/sec, that is, when the amount of compressed air in the tank 10A is increasing, the motor 33 is operated continuously at the rotational speed of N2 while the tank pressure P is not lower than 10 kg/cm$^2$, and the rotational speed of the motor 33 is switched over to N3 when the tank pressure P is reduced to be lower than 10 kg/cm$^2$. When $\Delta P/\Delta T$ is increased to be in a range of from +0.15 kg/cm$^2$/sec to +0.3 kg/cm$^2$/sec, the rotational speed of the motor 33 is controlled to be reduced from the current value N2 to N1 if the tank pressure is not lower than 10 kg/cm$^2$ because rapid increase in the tank pressure P is predicted.

Although the description has been made on the case where the rotational speed of the motor 33 currently operating is N2 and to be changed to N0, N3 or N1, controlling is made so that the rotational speed is changed on the basis of a different pattern as shown in FIG. 6, 7 or 8 when the current rotational speed is N3, N1 or N0.

Referring back to FIG. 14, in step 1115, the selected judgment table is searched to decide the rotational speed of the motor 33 on the basis of P(T+$\Delta$T) and $\Delta P/\Delta T$.

In step 1116, a judgment is made as to whether the rotational speed N selected in the step 1115 is N3 (=3600 rpm) or not. When the judgment results in YES, the current position of the program goes to step 1121 in which the temperature t of the motor 33 is measured. That is, even in the case where the judgment from the rotational speed transition judgment table is that the rotational speed of the motor 33 needs to be a high speed value N3, a decision can be made on the basis of the temperature of the motor 33 as to whether N3 must be selected finally or not. Although the temperature of the motor coils 331 to 333 is generally measured as the motor temperature t, the invention is not limited thereto.

In next step 1122, a judgment is made as to whether the measured temperature t is higher than a predetermined value or not. Although this embodiment shows the case where the predetermined value is set at 120° C., the invention is not limited thereto. When the judgment in the step 1122 results in NO, the rotational speed N of the motor 33 is set at a high value N3 (=3600 rpm) (in step 1123) because the temperature of the motor 33 is not higher than 120° C. so that a decision is made that the rotational speed of the motor can be increased without any obstacle. On the other hand, when the judgment in the step 1122 results in YES, the rotational speed N of the motor 33 is set at a middle value N2 (=2400 rpm) (in step 1124) because a decision is made that the efficiency of the air compressor will be lowered because of excessive increase in the temperature of the motor 33 when the rotational speed of the motor 33 is increased.

In this manner, the overheating of the motor 33 can be prevented because the rotational speed of the motor 33 is controlled not only on the basis of the change in tank pressure but also on the basis of the detected motor temperature, especially, the detected motor coil temperature.

Another example of the program for controlling the air compressor according to the second embodiment will be described below with reference to FIG. 15.

First in step 1101, initialization is performed so that the rotational speed N of the motor 33 is set at N2=2400 rpm in the same manner as in FIG. 4. In this embodiment, a short cycle ΔT1 of 0.05 sec and a long cycle ΔT2 of 5 sec are used as two kinds of sampling cycles ΔT in which a signal detected by the pressure sensor 11 of the air tank 10A can be taken in the control circuit portion 40. That is, change in tank pressure on the basis of the difference between P(i−1) and P(i) is detected at intervals of 0.05 sec while change in tank pressure on the basis of the difference between P(i=0) and P(i=100) is detected at intervals of 5 sec on the assumption of i=0, 1, 2, 3, . . . , 100. Although this embodiment shows the case where the short cycle is set at 0.05 sec, it is a matter of course that the invention need not be limited to this numerical value because the short cycle is set for detecting ripples of tank pressure generated when a nailing machine (or the like) spending a large amount of air in a cycle operates and because the short cycle depends on a pneumatic tool used. Similarly, the long cycle need not be limited to 5 sec because the long cycle is set for detecting tank pressure change due to the use of a pneumatic tool.

Then, the current position of the program goes to step 1104 in which data of rotational speed used for controlling the air compressor according to the invention are stored. In this embodiment, the values of N0, N1, N2 and N3 are stored in a suitable region of the RAM 42 because this embodiment is designed so that the rotational speed N of the motor 33 is controlled in four stages of N0 (=0 rpm), N1 (=1200 rpm), N2 (=2400 rpm) and N3 (=3600 rpm). Although it is easy to set the rotational speed of the motor 33 more multistageously, it is preferable that the number of stages is at least three.

Then, the current position of the program goes to step 1105 in which the pressure P(i) of compressed air in the tank 10A is measured and stored. In step 1106, a judgment is made as to whether the measured pressure P(i) is higher than 30 kg/cm$^2$ or not. When the judgment results in YES, the current position of the program goes to step 1107 in which the rotational speed N of the motor 33 is set at N0 (0 rpm). That is, because this embodiment is designed so that the pressure in the tank 10A is controlled to be kept in a range of from 20 kg/cm$^2$ to 30 kg/cm$^2$, the rotation of the motor 33 is stopped when the tank pressure is higher than 30 kg/cm$^2$.

When the judgment in the step 1106 results in NO, the current position of the program goes to step 1108 in which (i+1) is substituted for (i). Then, in step 1109, the tank pressure P(i) is measured and the value of P(i) is stored together with P(i−1). Further, in step 1110, the CPU 41 calculates the rate ΔP1/ΔT1 (={P(i)−P(i−1)}/0.05) of pressure change ΔP1 to the short cycle ΔT1.

Further, in step 1111, a judgment is made as to whether the pressure change rate ΔP1/ΔT1 in the short cycle is smaller than a predetermined value or not. This judgment is equivalent to a judgment as to whether or not a pneumatic tool connected to the air tank 10A operates in a state such as a continuous nailing state in which a large amount of air needs to be spent in a short time. In this embodiment, the predetermined value is set at −1. When continuous nailing is performed, the tank pressure pulsates to intensify ripples of the pressure change. When reduction of ΔP1 in ΔT1 is larger than (−1) (i.e., ΔP1/ΔT1<−1), the current position of the program goes to step 1125 because a decision is made on the basis of the amplitude of the ripples that the pneumatic tool is used in a state such as a continuous nailing state.

In the step 1125, the voltage E of the AC source 310 in the power supply circuit 31 (FIG. 3) is detected by the detector 311. Further, in step 1126, a judgment is made as to whether the value of E is lower than a predetermined value or not. In this embodiment, the predetermined value is set at 90 V. That is, when a large amount of air is spent by the pneumatic tool, it is preferable that the rotational speed of the motor 33 is increased immediately to increase the amount of compressed air generated. When, for example, another pneumatic tool is connected to the tank 10A, there is however the possibility that the load on the AC source 310 may become so high that a circuit breaker (not shown) for the power supply circuit 31 (FIG. 3) operates. In order to avoid this disadvantage, the judgment in the step 1126 is made as to whether the value of the power-supply voltage E is lower than a predetermined value (90 V) or not. When the judgment in the step 1126 results in YES, that is, when the power-supply voltage ordinarily equal to 100 V is reduced to a value of not higher than 90 V, the rotational speed N of the motor 33 is kept at N2 (=2400 rpm) because a decision is made that the load on the AC source 310 due to the use of the other pneumatic tool is considerably high.

When the voltage of the AC source 310 is not lower than 90 V, the current position of the program goes to step 1127 in which a current I flowing in the power supply circuit 31 is detected by the current detector 312. Then, in step 1128, a judgment is made as to whether the measured current I is larger than a predetermined value or not. In this embodiment, the predetermined value is set at 30 A. When this judgment results in YES, the current position of the program still goes to step 1132 because a decision is made that there is the possibility that the circuit breaker of the AC source 310 may operate if the rotational speed N of the motor 33 is increased from the current rotational speed value. In step 1132, the rotational speed of the motor 33 is kept at N2 (=2400 rpm).

When the judgment in the step 1128 results in NO, the current position of the program goes to step 1129 in which the coil temperature t of the stator 331 in the motor 33 is measured. Further, in step 1130, a judgment is made as to whether the coil temperature t is higher than a predetermined value or not. In this embodiment, the predetermined value is set at 120° C. If the rotational speed of the motor 33 is increased more in the condition that the motor coil temperature t is not lower than 120° C., there is the possibility that excessive increase in the motor coil temperature t may result in an obstacle to the operation of the motor, and there is the possibility that the excessive rise in temperature may cause remarkable reduction in compressed air generating efficiency of the compressed air generation portion 20. Therefore, when the judgment in the step 1130 results in YES, the current position of the program still goes to step 1132 in which the rotational speed N of the motor 33 is kept at N2 (=2400 rpm).

When the judgment in the step 1130 results in NO, the current position of the program goes to step 1131 in which the rotational speed N of the motor 33 is set at N3 (=3600 rpm).

In next step 1133, i is reset to zero. In step 1134, a judgment is made as to whether the pressure P(i) in the tank 10A is higher than 30 kg/cm$^2$ or not. When this judgment results in YES, the current position of the program goes back to the step 1107 in which the rotation of the motor 33 is stopped. When the judgment in the step 1134 results in NO, the current position of the program goes to step 1135 in which an arithmetic operation for substituting i+1 for i is carried out. Then, in step 1136, a judgment is made as to whether i reaches 100 or not, that is, whether the time of 5 sec has passed or not. When this judgment results in YES, i is replaced by i=0 (step 1102) and the current position of the program goes back to the step 1104. The steps 1134 to 1136 are provided for controlling the rotational speed of the motor 33 to be kept constant for 5 sec in order to prevent a sense of discomfort from being given when the rotational speed of the motor 33 is changed at intervals of 0.05 sec.

On the other hand, when the judgment in the step 1111 results in NO, that is, when the tank pressure change rate in the short cycle (0.05 sec) is not smaller than the predetermined value, the current position of the program goes to step 1112 in which a judgment is made as to whether the time ΔT2 (=5 sec) has passed or not. When this judgment results in NO, the current position of the program goes back to the step 1106. When this judgment results in YES, the current position of the program goes to step 1113 in which the pressure change rate ΔP2/ΔT2 (={P(i=100)−P(i=0)}/5) in the long cycle (5 sec) is calculated.

In next step 1114, a rotational speed transition judgment table is selected. The description of the steps 1114 to 1116 will be omitted because the steps 1114 to 1116 are equivalent to those in the embodiment shown in FIG. 14. When the rotational speed N consequently selected is N3 (=3600 rpm) (in step 1116), next steps 1117 to 1122 are executed to judge whether the power-supply voltage E is lower than 90 V or not, whether the load current I is larger than 30 A or not, and whether the motor coil temperature t is higher than 120° C. or not. The detailed description of the steps 1117 to 1122 will be omitted because the steps 1117 to 1122 are functionally equivalent to the steps 1125 to 1130. In short, the steps 1117 to 1122 show a flow chart for preventing the operation of the circuit breaker (not shown) of the AC source and preventing the overheating of the motor 33.

When the judgments in the steps 1117 to 1122 make a decision that the operation of the circuit breaker and the overheating of the motor can be prevented even in the case where the rotational speed N of the motor 33 is switched over to the highest value of 3600 rpm, the current position of the program goes to step 1123 in which the rational speed N of the motor 33 is set at N3 (=3600 rpm). On the other hand, when the conditions are not satisfied, the current position of the program goes to step 1124 in which the rotational speed N of the motor 33 is kept at N2. That is, in the invention, controlling is made so that the rotational speed of the motor 33 is increased to N3 when both the pressure change rate in the short cycle (0.05 sec) and the pressure change rate in the long cycle (5 sec) are so high that high air consumption is predicted, but the rotational speed of the motor 33 is kept at N2 when the load on the motor 33 is so considerably heavy that there is the possibility that the breaker may be operated or the motor coil temperature may increase excessively.

As is obvious from the above description, in accordance with the invention, an air compressor for controlling the rotational speed of a motor multistageously on the basis of the pressure in a tank is provided so that the motor is rotated not at a high speed but a middle speed when the temperature of the motor is not lower than a predetermined value. Accordingly, lowering of efficiency caused by overheating of the motor can be prevented.

The air compressor has detection circuits for detecting a power-supply voltage and a load current of a power supply circuit for the motor. The air compressor is configured so that the motor is not rotated at a high speed when the power-supply voltage is lower than a predetermined value or the load current is larger than a predetermined value. Accordingly, both excessive increase in motor coil temperature and operation of a circuit breaker of an AC source can be prevented.

The Third Exemplary Embodiment

A third exemplary embodiment of the invention will be described below in detail.

In this third embodiment, elements common with those of the first embodiment will be referred by the same references and the explanations for the common elements will be omitted.

The air compressor according to the third embodiment is broadly the same as that of the first embodiment shown in FIGS. 1-3, but different in the configuration of control program stored in the ROM 43 of the control circuit portion 40. Hereinbelow, the configuration of the control program according to the second embodiment and an operation of the apparatus based on the control program will be described.

(5") Control Program

FIG. 16 is a flow chart showing an embodiment of the program stored in the ROM 43 of the control circuit portion 40 in the invention.

First in step 2101, initialization is performed so that the rotational speed N of the motor 33 is set at N2=2400 rpm. A short cycle ΔT1 of 0.05 sec and a long cycle ΔT2 of 5 sec are used as two kinds of sampling cycles ΔT in which a signal detected by the pressure sensor 11 of the air tank 10A can be taken in the control circuit portion 40. That is, change in tank pressure on the basis of the difference between P(i−1) and P(i) is detected at intervals of 0.05 sec while change in tank pressure on the basis of the difference between P(i=0) and P(i=100) is detected at intervals of 5 sec on the assumption of i=0, 1, 2, 3, . . . , 100. Although this embodiment shows the case where the short cycle is set at 0.05 sec, it is a matter of course that the invention need not be limited to this numerical value because the short cycle is set for detecting ripples of tank pressure generated when a nailing machine (or the like) spending a large amount of air in a cycle operates and because the short cycle depends on a pneumatic tool used. Similarly, the long cycle need not be limited to 5 sec because the long cycle is set for detecting tank pressure change due to the use of a pneumatic tool.

Then, the current position of the program goes to step 104 in which data of rotational speed used for controlling the air compressor according to the invention are stored. In this embodiment, the values of N0, N1, N2 and N3 are stored in a suitable region of the RAM 42 because this embodiment is designed so that the rotational speed N of the motor 33 is controlled in four stages of N0 (=0 rpm), N1 (=1200 rpm), N2 (=2400 rpm) and N3 (=3600 rpm). Although it is easy to set the rotational speed of the motor 33 more multistageously, it is preferable that the number of stages is at least three.

Then, the current position of the program goes to step 105 in which the pressure P(i) of compressed air in the tank 10A is measured and stored. In step 2106, a judgment is made as to whether the measured pressure P(i) is higher than 30 kg/cm$^2$ or not. When the judgment results in YES, the current position of the program goes to step 2107 in which the rotational speed N of the motor 33 is set at N0 (0 rpm). That is, because this embodiment is designed so that the pressure in the tank 10A is controlled to be kept in a range of from 20 kg/cm$^2$ to 30 kg/cm$^2$, the rotation of the motor 33 is stopped when the tank pressure is higher than 30 kg/cm$^2$.

When the judgment in the step 2106 results in NO, the current position of the program goes to step 2108 in which (i+1) is substituted for (i). Then, in step 2109, the tank pressure P(i) is measured and the value of P(i) is stored together with P(i−1). Further, in step 2110, the CPU 41 calculates the rate ΔP1/ΔT1 (={P(i)−P(i−1)}/0.05) of pressure change ΔP1 to the short cycle ΔT1.

Further, in step 2111, a judgment is made as to whether the pressure change rate ΔP1/ΔT1 in the short cycle is smaller than a predetermined value or not. This judgment is equivalent to a judgment as to whether or not a pneumatic tool connected to the air tank 10A operates in a state such as a continuous nailing state in which a large amount of air needs to be spent in a short time. In this embodiment, the predetermined value is set at −1. When continuous nailing is performed, the tank pressure pulsates to intensify ripples of the pressure change. When reduction of ΔP1 in ΔT1 is larger than (−1) (i.e., ΔP1/ΔT1<−1), the current position of the program goes to step 2125 because a decision is made on the basis of the amplitude of the ripples that the pneumatic tool is used in a state such as a continuous nailing state.

In the step 2125, the voltage E of the AC source 310 in the power supply circuit 31 (FIG. 3) is detected by the detector 311. Further, in step 2126, a judgment is made as to whether the value of E is lower than a predetermined value or not. In this embodiment, the predetermined value is set at 90 V. That is, when a large amount of air is spent by the pneumatic tool, it is preferable that the rotational speed of the motor 33 is increased immediately to increase the amount of compressed air generated. When, for example, another pneumatic tool is connected to the tank 10A, there is however the possibility that the load on the AC source 310 may become so high that a circuit breaker (not shown) for the power supply circuit 31 (FIG. 3) operates. In order to avoid this disadvantage, the judgment in the step 2126 is made as to whether the value of the power-supply voltage E is lower than a predetermined value (90 V) or not. When the judgment in the step 2126 results in YES, that is, when the power-supply voltage ordinarily equal to 100 V is reduced to a value of not higher than 90 V, the rotational speed N of the motor 33 is kept at N2 (=2400 rpm) because a decision is made that the load on the AC source 310 due to the use of the other pneumatic tool is considerably high.

When the voltage of the AC source 310 is not lower than 90 V, the current position of the program goes to step 2127 in which a load current I flowing in the power supply circuit 31 is detected by the current detector 312. Then, in step 2128, a judgment is made as to whether the measured current I is larger than a predetermined value or not. In this embodiment, the predetermined value is set at 30 A. When this judgment results in YES, the current position of the program still goes to step 2132 because a decision is made that there is the possibility that the coil temperature of the motor 33 may increase excessively or the circuit breaker of the AC source 310 may operate if the rotational speed N of the motor 33 is increased from the current rotational speed value. In step 2132, the rotational speed of the motor 33 is kept at N2 (=2400 rpm).

When the judgment in the step 2128 results in NO, the current position of the program goes to step 2129 in which the coil temperature t of the stator 331 in the motor 33 is measured. Further, in step 2130, a judgment is made as to whether the coil temperature t is higher than a predetermined value or not. In this embodiment, the predetermined value is set at 120° C. Although this embodiment shows the case where the coil temperature t of the motor 33 is measured, the temperature of another place may be measured. If the rotational speed of the motor 33 is increased more in the condition that the motor coil temperature t is not lower than 120° C., there is the possibility that excessive increase in the motor coil temperature t may result in an obstacle to the operation of the motor, and there is the possibility that the excessive rise in temperature may cause remarkable reduction in compressed air generating efficiency of the compressed air generation portion 20. Therefore, when the judgment in the step 2130 results in YES, the current position of the program still goes to step 2132 in which the rotational speed N of the motor 33 is kept at N2 (=2400 rpm).

When the judgment in the step 2130 results in NO, the current position of the program goes to step 2131 in which the rotational speed N of the motor 33 is set at N3 (=3600 rpm).

In next step 2133, i is reset to zero. In step 2134, a judgment is made as to whether the pressure P(i) in the tank 10A is higher than 30 kg/cm$^2$ or not. When this judgment results in YES, the current position of the program goes back to the step 2107 in which the rotation of the motor 33 is stopped. When the judgment in the step 2134 results in NO, the current position of the program goes to step 2135 in which an arithmetic operation for substituting i+1 for i is carried out. Then, in step 2136, a judgment is made as to whether i reaches 100 or not, that is, whether the time of 5 sec has passed or not. When this judgment results in YES, i is replaced by i=0 (step 102) and the current position of the program goes back to the step 2104. The steps 2134 to 2136 are provided for controlling the rotational speed of the motor 33 to be kept constant for 5 sec in order to prevent a sense of discomfort from being given when the rotational speed of the motor 33 is changed at intervals of 0.05 sec.

On the other hand, when the judgment in the step 2111 results in NO, that is, when the tank pressure change rate in the short cycle (0.05 sec) is not smaller than the predetermined value, the current position of the program goes to step 2112 in which a judgment is made as to whether the time ΔT2 (=5 sec) has passed or not. When this judgment results in NO, the current position of the program goes back to the step 2106. When this judgment results in YES, the current position of the program goes to step 2113 in which the pressure change rate ΔP2/ΔT2 (={P(i=100)−P(i=0)}/5) in the long cycle (5 sec) is calculated.

In next step 2114, a rotational speed transition judgment table is selected. Four kinds of rotational speed transition judgment tables as shown in FIGS. 5, 6, 7 and 8 are stored in the RAM 42 of the control circuit portion 40 in advance. When the current rotational speed N of the motor 33 is the initial value N2 (=2400 rpm), the table shown in FIG. 5 is selected. When the current rotational speed N of the motor 33 is N3 (=3600 rpm), the table shown in FIG. 6 is selected. When the current rotational speed N of the motor 33 is N1, the table shown in FIG. 7 is selected. Similarly, when the current rotational speed N of the motor 33 is NO, the table shown in FIG. 8 is selected. In each of the tables, tank pressure P is taken in the vertical axis and pressure change rate ΔP/ΔT of the tank pressure is taken in the horizontal axis, so that each table is used for deciding the rotational speed of the motor 33 on the basis of the values of P and ΔP/ΔT.

Referring to FIG. 5 by way of example, when the tank pressure P is higher than 30 kg/cm$^2$, the rotational speed is set at NO regardless of the value of ΔP/ΔT. That is, the motor is stopped. This is natural because the tank pressure is controlled to be always kept in a range of from 26 kg/cm$^2$ to 30 kg/cm$^2$.

Because the fact that the pressure change rate ΔP/ΔT has a minus value means the fact that the amount of spent compressed air is larger than the amount of compressed air supplied to the tank 10A, controlling is made so that the current rotational speed N2 (=2400 rpm) of the motor 33 is switched over to a higher value N3 (=3600 rpm). Particularly in the case where the pneumatic tools 51 and 52 (FIG. 1) are operated fully, there is the possibility that the pressure in the tank 10A may be lowered rapidly because a large amount of compressed air is spent. In this case, therefore, when ΔP/ΔT is not larger than −1 kg/cm$^2$/sec, the rotational speed is switched over to N3 immediately if the tank pressure P is 30 kg/cm$^2$. However, when the pressure change rate ΔP/ΔT is relatively small to be in a range of from −1 kg/cm$^2$/sec to 0 kg/cm$^2$/sec, the motor 33 is operated continuously at the rotational speed of N2 while the pressure P in the tank 10A is not lower than 26 kg/cm$^2$, and the rotational speed of the motor 33 is switched over to N3 when the pressure P in the tank 10A is reduced to be lower than 26 kg/cm$^2$. On the other hand, when ΔP/ΔT is in a range of from 0 kg/cm$^2$/sec to +0.1 kg/cm$^2$/sec, that is, when the amount of supplied compressed air is slightly larger than the amount of spent compressed air, the motor 33 is operated continuously at the rotational speed of N2 while the pressure P in the tank 10A is not lower than 20 kg/cm$^2$, and the rotational speed of the motor 33 is switched over to N3 when the pressure P in the tank 10A is reduced to be lower than 20 kg/cm$^2$.

When the value of ΔP/ΔT is in a range of from +0.1 kg/cm$^2$/sec to +0.15 kg/cm$^2$/sec, that is, when the amount of compressed air in the tank 10A is increasing, the motor 33 is operated continuously at the rotational speed of N2 while the tank pressure P is not lower than 10 kg/cm$^2$, and the rotational speed of the motor 33 is switched over to N3 when the tank pressure P is reduced to be lower than 10 kg/cm$^2$. When ΔP/ΔT is increased to be in a range of from +0.15 kg/cm$^2$/sec to +0.3 kg/cm$^2$/sec, the rotational speed of the motor 33 is controlled to be reduced from the current value N2 to N1 if the tank pressure is not lower than 10 kg/cm$^2$ because rapid increase in the tank pressure P is predicted.

Although the description has been made on the case where the rotational speed of the motor 33 currently operating is N2 and to be changed to N0, N3 or N1, controlling is made so that the rotational speed is changed on the basis of a different pattern as shown in FIG. 6, 7 or 8 when the current rotational speed is N3, N1 or N0.

In next step 2115, the selected table is searched to decide the next rotational speed of the motor 33 on the basis of the tank pressure P(i=100) after the passage of 5 sec and the pressure change rate ΔP2/ΔT2 in the time ΔT2 of 5 sec. When the rotational speed N consequently selected is N3 (=3600 rpm) (step 2116), the rotational speed is not immediately switched over to N3 but next steps 2117 to 2122 are executed to judge whether the power-supply voltage E is lower than 90 V or not, whether the load current I is larger than 30 A or not, and whether the motor coil temperature t is higher than 120° C. or not. The detailed description of the steps 2117 to 2122 will be omitted because the steps 2117 to 2122 are functionally equivalent to the steps 2125 to 2130. In short, the steps 2117 to 2122 show a flow chart for preventing the operation of the circuit breaker (not shown) of the AC source and preventing the overheating of the motor 33.

When the judgments in the steps 2117 to 2122 make a decision that the operation of the circuit breaker and the overheating of the motor 33 can be prevented even in the case where the rotational speed N of the motor 33 is switched over to the highest value of 3600 rpm, the current position of the program goes to step 2123 in which the motor speed N is set at N3 (=3600 rpm). On the other hand, when the conditions are not satisfied, the current position of the program goes to step 2124 in which the rotational speed N of the motor 33 is kept at N2. That is, in the invention, controlling is made so that the rotational speed of the motor 33 is increased to N3 when both the pressure change rate in the short cycle (0.05 sec) and the pressure change rate in the long cycle (5 sec) are so high that high air consumption is predicted, but the rotational speed of the motor 33 is kept at N2 when the load on the motor 33 is so considerably heavy that there is the possibility that the circuit breaker may be operated or the motor coil temperature may increase excessively.

(6") Operation

The operation of the air compressor according to the invention will be described below with reference to FIG. 17.

Figure 17:
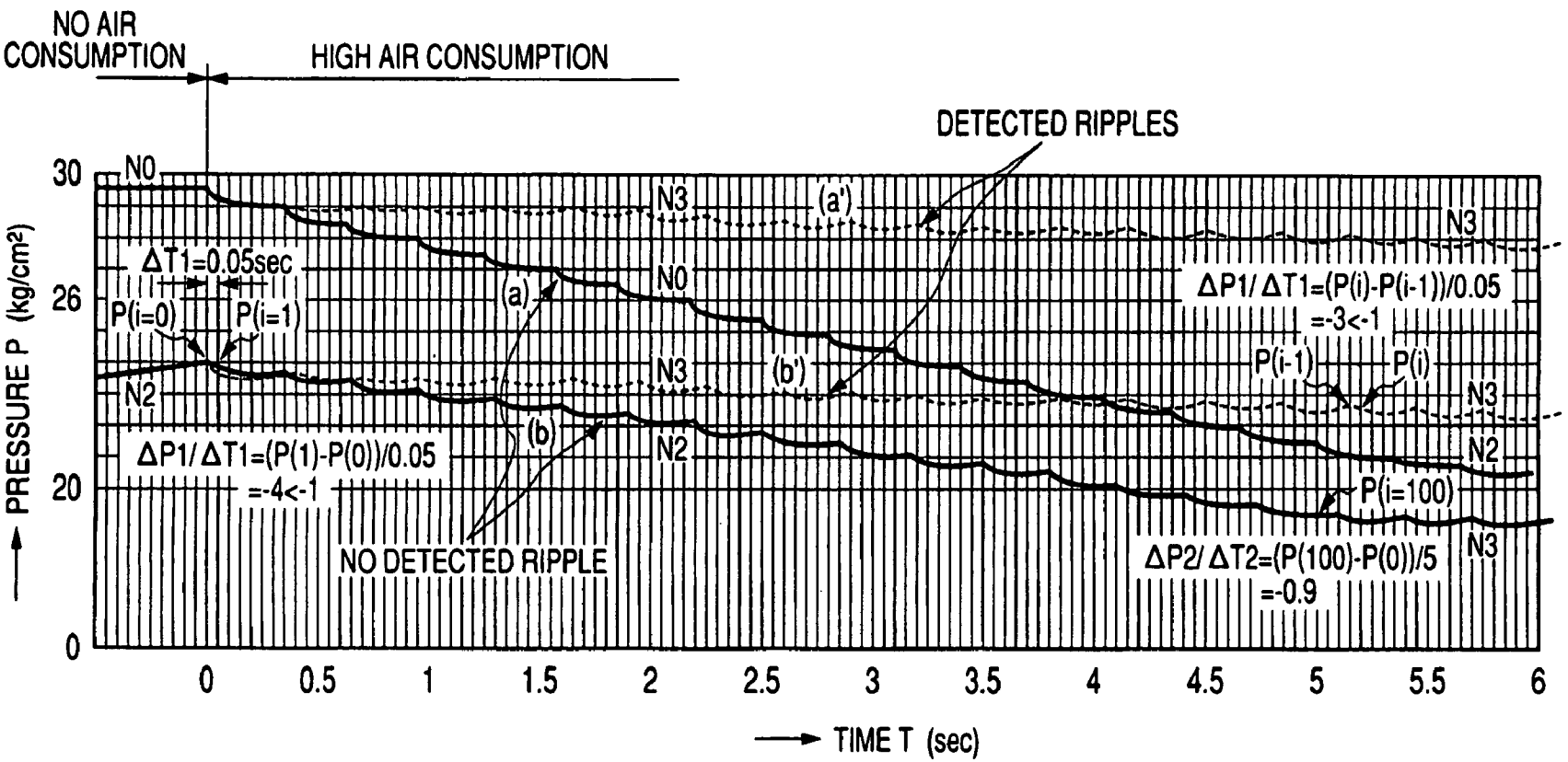
FIG. 17 is a graph of a pressure change curve for explaining the operation of the air compressor according to the invention.

In the graph shown in FIG. 17, time is taken as the horizontal axis, and pressure of compressed air in the tank is taken as the vertical axis. The curves a and b show the case where ripples of the tank pressure are not detected, that is, the case where controlling is made on the basis of the pressure change rate in the long cycle (5 sec) but controlling is not made on the basis of the pressure change rate in the short cycle (0.05 sec). The curves a' and b' show the case where ripples of the tank pressure are detected, that is, the case where controlling is made on the basis of the two pressure change rates.

The curve a shows the tank pressure P of 29 kg/cm$^2$ before the time T=0. That is, the curve a shows a state in which the motor 33 stops before the time T=0 in the condition that there is no compressed air consumption. When, for example, continuous nailing due to a nailing machine starts at the time T=0, the tank pressure is reduced rapidly while pulsating because a large amount of air is spent. At the time T=5 (sec), the pressure change rate ΔP2/ΔT2 in the cycle of 5 sec is calculated. Because the rate ΔP2/ΔT2 is −1.7, a middle rotational speed N2=2400 rpm is selected from the rotational speed transition judgment table. Accordingly, the motor is rotated at a rotational speed of N0 in a period of from T=0 (sec) to T=5 (sec) and at a rotational speed of N2 after T=5 (sec).

The curve a' shows the case where ripples (ΔP1/ΔT1) are detected. Before the time T=0, the tank pressure P is 29 kg/cm$^2$ and the motor 33 stops. When continuous nailing starts at the time T=0, the tank pressure is first reduced while pulsating in the same manner as in the case of the curve a. The pressure change rate (ΔP1/ΔT1) of ripples is however calculated after the passage of ΔT1=0.05 sec. Because the rate ΔP1/ΔT1 is −5 (<−1), the ripples are judged to be large. Because the power-supply voltage E is not lower than 90 V, the load current I is not larger than 30 A and the motor coil temperature t is not higher than 120° C., the rotational speed shifts to a high value N3=3600 rpm immediately. Accordingly, the motor 33 is rotated at a high speed of N3=3600 rpm after the passage of ΔT1=0.05 sec. Consequently, reduction in the tank pressure is suppressed as shown in the curve a', so that the tank pressure is kept about 29 kg/cm$^2$.

On the other hand, the curve b shows the tank pressure P of not higher than 26 kg/cm$^2$ before the time T=0. That is, the curve b shows a state in which the motor 33 is rotated at a middle speed of N2=2400 rpm to increase the tank pressure P slowly before the time T=0 in the condition that there is no compressed air consumption. In this state, when continuous nailing starts at T=0, the tank pressure P is reduced while pulsating. After the passage of 5 sec, the pressure change rate ΔP2/ΔT2 is calculated. Because the rate ΔP2/ΔT2 is −0.9, N3=3600 rpm is selected from the rotational speed transition judgment table. Accordingly, the motor 33 is rotated at a middle speed of N2=2400 rpm before T=5 (sec) and the rotational speed is switched over to a high rotational speed of N3=3600 rpm after T=5 (sec). The tank pressure is however reduced considerably in the period of 5 sec.

On the other hand, the curve b' also shows the tank pressure P of not higher than 26 kg/cm$^2$ before the time T=0. That is, the curve b' shows a state in which the motor 33 is rotated at a middle speed of N2=2400 rpm before the time T=0 in the condition that there is no compressed air consumption. Continuous nailing starts at T=0. In this case, ripples (ΔP1/ΔT1) are detected. Accordingly, the pressure change rate ΔP1/ΔT1 is calculated after the passage of ΔT1=0.05 sec. Because the rate ΔP1/ΔT1 is −4 (<−1), ripples are judged to be large. Because the power-supply voltage E is not lower than 90 V, the load current I is not larger than 30 A and the motor coil temperature t is not higher than 120° C., the rotational speed shifts to a high value N3=3600 rpm immediately after the passage of ΔT1=0.05 sec. Accordingly, reduction in the tank pressure is suppressed compared with the curve b, so that the tank pressure level after continuous nailing can be kept substantially equal to the tank pressure level at T=0.

As is obvious from the above description, the air compressor according to the invention is configured so that the rotational speed of the motor is set multistageously, and that the pressure change rate in the short cycle, for example, of about 0.05 sec and the pressure change rate in the long cycle, for example, of about 5 sec are calculated on the basis of the detection signals output from the pressure sensor of the air tank so that the rotational speed of the motor is controlled on the basis of the two pressure change rates. Accordingly, when only air due to air leakage is spent because the air compressor is in a standby state, or when a small amount of air is spent because a small-size pneumatic tacker or the like is used, the motor can be rotated at a lower speed to reduce noise.

On the other hand, when a large amount of air is spent in a short time because continuous nailing is made by a large-size nailing machine, the rotational speed of the motor can be shifted to a high value immediately to suppress reduction in the tank pressure. Accordingly, even in the case where nails for concrete or large-diameter nails for wood need to be driven continuously, the frequency of "shallow nailing" can be reduced. Even in the case where nailing is performed shallowly, the "shallow nailing" time can be shortened extremely.

In addition, when the rotational speed of the motor is shifted to a high value because large ripples of the tank pressure are detected, the motor is controlled so that the rotational speed of the motor is kept for at least a predetermined time (e.g., 5 sec). Accordingly, the rotational speed of the motor can be prevented from being changed frequently in a short time, so that the sense of discomfort can be reduced.

What is claimed is:

1. An air compressor, comprising:

a tank portion for reserving compressed air to be used in a pneumatic tool;

a compressed air generation portion for generating compressed air and supplying said compressed air to said tank portion;

a drive portion comprising a motor for driving said compressed air generation portion;

a pressure sensor for detecting an internal pressure P of said tank portion; and a control circuit portion for controlling said drive portion, the control circuit portion comprising:

first means for storing a plurality of values indicating different rotational speeds of the motor;

second means for calculating a rate ΔP/ΔT of change of the internal pressure ΔP with respect to a change in time ΔT; and third means for selecting one of the values based on the internal pressure P and the rate ΔP/ΔT of change of the internal pressure, and controlling the rotational speed of said motor in accordance with the selected value.

2. The air compressor according to claim 1, wherein said control circuit portion further comprises a memory for storing information indicating relations among the internal pressure P of said tank portion, the rate ΔP/ΔT of change of the internal pressure, and the rotational speeds of said motor, and wherein one of the rotational speeds of said motor is decided by means for searching said memory.

3. The air compressor according to claim 2, wherein the one of the rotational speeds of said motor is selected based on a currently operating motor speed.

4. The air compressor according to claim 2, wherein the memory stores a plurality of patterns indicating relations among the internal pressure P of said tank portion, the rate ΔP/ΔT of change of the internal pressure, and the rotational speeds of said motor.

5. The air compressor according to claim 1, wherein the plurality of values comprises integral times of a predetermined rotational speed.

6. The air compressor according to claim 1, wherein each of the plurality of values comprises an integral times a predetermined rotational speed.

7. The air compressor according to claim 1, wherein said control circuit portion further comprises fourth means for judging whether the internal pressure P in the tank is higher than a predetermined value and for controlling the motor to stop when the internal pressure P is higher than the predetermined value.

8. The air compressor according to claim 1, wherein the rotational speed of the motor is set in multiple stages to be integral multiples of a reference value.

9. The air compressor according to claim 1, wherein said control circuit portion calculates a first rate ΔP1/ΔT1 of change of the internal pressure ΔP1 over a change in time ΔT1 and a second rate ΔP2/ΔT2 of change of the internal pressure ΔP2 over a change in time ΔT2 longer than the change in time ΔT1.

10. The air compressor according to claim 9, wherein said control circuit portion selects one of the rotational speeds based on the first rate of change of the internal pressure and the second rate of change of the internal pressure.

11. An air compressor, comprising:

a tank portion for reserving compressed air to be used in a pneumatic tool;

a compressed air generation portion for generating compressed air and supplying said compressed air to said tank portion;

a drive portion including a motor for driving said compressed air generation portion;

a control circuit portion for controlling said drive portion;

a temperature sensor for detecting the temperature of said motor of said drive portion; and a pressure sensor for detecting an internal pressure of compressed air in said tank portion, wherein said control circuit portion controls a rotational speed of said motor based on a detection signal output from said temperature sensor and a rate ΔP/ΔT of change of the internal pressure ΔP with respect to a change in time ΔT.

12. The air compressor according to claim 11, wherein said control circuit portion controls the rotational speed of said motor in at least three stages of high speed, middle speed, and low speed.

13. The air compressor according to claim 11, wherein the rotational speed of the motor is set in multiple stages to be integral multiples of a reference value.

14. An air compressor, comprising:

a tank portion for reserving compressed air to be used in a pneumatic tool;

a compressed air generation portion for generating compressed air and supplying said compressed air to said tank portion;

a drive portion including a motor for driving said compressed air generation portion;

a control circuit portion for controlling said drive portion;

a voltage detection circuit for detecting a power-supply voltage of said drive portion;

a current detection circuit for detecting a load current of said drive portion; and a pressure sensor for detecting an internal pressure of compressed air in said tank portion, wherein said control circuit portion controls a rotational speed of said motor based on a detection signal output from at least one of said voltage detection circuit and said current detection circuit, and a rate $\Delta P/\Delta T$ of change of the internal pressure $\Delta P$ with respect to a change in time $\Delta T$.

15. A method of controlling an air compressor, including a tank portion for reserving compressed air to be used in a pneumatic tool, a compressed air generation portion for generating compressed air and supplying said compressed air to said tank portion, a drive portion having a motor for driving said compressed air generation portion, and a control circuit portion for controlling said drive portion, said method comprising:

detecting a temperature of said motor of said drive portion by a temperature sensor;

detecting an internal pressure of compressed air in said tank portion by a pressure sensor; and controlling a rotational speed of said motor in at least three stages of high speed, middle speed, and low speed based on a detection signal output from said temperature sensor and a rate $\Delta P/\Delta T$ of change of the internal pressure $\Delta P$ with respect to a change in time $\Delta T$.

16. The method of claim 15, further comprising:

storing a plurality of values indicating different rotational speeds of the motor; and selecting one of the plurality of values based on the pressure of said tank portion and the rate of change of the internal pressure, wherein said controlling the rotational speed of said motor is in accordance with the one of the plurality of values.

17. The method of claim 16, wherein each of the plurality of values comprises integral times of a predetermined rotational speed.

18. A method of controlling an air compressor, including a tank portion for reserving compressed air to be used in a pneumatic tool, a compressed air generation portion for generating compressed air and supplying said compressed air to said tank portion, a drive portion having a motor for driving said compressed air generation portion, and a control circuit portion for controlling said drive portion, said method comprising:

detecting a power-supply voltage of said drive portion and a load current of said drive portion;

detecting an internal pressure of compressed air in said tank portion by a pressure sensor; and controlling a rotational speed of said motor in at least three stages of high speed, middle speed, and low speed based on the detected power-supply voltage and detected load current, and a rate $\Delta P/\Delta T$ of change of the internal pressure $\Delta P$ with respect to a change in time $\Delta T$.

19. The method of claim 18, further comprising:

storing a plurality of values indicating different rotational speeds of the motor; and selecting one of the plurality of values based on the pressure P of said tank portion and the rate $\Delta P/\Delta T$ of change of the internal pressure $\Delta P$, wherein said controlling the rotational speed of said motor is in accordance with the one of the plurality of values.

20. The method of claim 19, wherein each of the plurality of values comprises integral times of a predetermined rotational speed.

21. An air compressor, comprising:

a tank portion configured to reserve compressed air to be used in a pneumatic tool;

a compressed air generation portion configured to generate said compressed air and supply said compressed air to said tank portion;

a motor configured to drive said compressed air generation portion;

a pressure sensor configured to detect an internal pressure P of said tank portion; and a control circuit portion configured to control the motor such that the motor is turned off when the internal pressure P is lower than a predetermined value and is turned on when the internal pressure P is greater than the predetermined value, wherein the control circuit portion comprises:

first means for storing a plurality of predetermined values indicating different rotational speeds of the motor;

second means for calculating a rate $\Delta P/\Delta T$ of change of the internal pressure $\Delta P$ with respect to a charge in time $\Delta T$; and third means for selecting one of the stored values based on both the internal pressure P and the rate $\Delta P/\Delta T$ of change of the internal pressure, and wherein the control circuit portion is configured to shift the rotational speed of the motor from one of the stored values to an other of the stored values based on both the internal pressure P and the rate $\Delta P/\Delta T$ of change of the internal pressure when the motor is turned on.

22. The air compressor according to claim 21 further comprising a temperature sensor for detecting a temperature of the motor, wherein the third means selects one of the values depending on the internal pressure P, the rate $\Delta P/\Delta T$, and the detected temperature.

23. The air compressor according to claim 21, further comprising a current detection circuit for detecting a load current of the motor, wherein the third means selects one of the values depending on the internal pressure P, the rate $\Delta P/\Delta T$, and the detected load current.

* * * * *